US007332669B2

(12) United States Patent
Shadd

(10) Patent No.: US 7,332,669 B2
(45) Date of Patent: Feb. 19, 2008

(54) ACOUSTIC PIANO WITH MIDI SENSOR AND SELECTIVE MUTING OF GROUPS OF KEYS

(76) Inventor: Warren M. Shadd, 2806 West Ave., Forestville, MD (US) 20747

( * ) Notice: Subject to any disclaimer, the term of this patent is extended or adjusted under 35 U.S.C. 154(b) by 146 days.

(21) Appl. No.: 10/454,537

(22) Filed: Jun. 5, 2003

(65) Prior Publication Data

US 2004/0025676 A1 Feb. 12, 2004

Related U.S. Application Data

(60) Provisional application No. 60/401,347, filed on Aug. 7, 2002.

(51) Int. Cl.
*G10H 1/18* (2006.01)
*G10H 3/12* (2006.01)
*G10H 7/00* (2006.01)

(52) U.S. Cl. ..... 84/742; 84/645; 84/741

(58) Field of Classification Search ..... 84/723, 84/731, 741, 477 R, 478, DIG. 1, DIG. 6, 84/DIG. 10, 742, 645
See application file for complete search history.

(56) References Cited

U.S. PATENT DOCUMENTS

| | | | | |
|---|---|---|---|---|
| 1,995,317 | A | 3/1935 | Loar | |
| 2,185,734 | A | 1/1940 | Loar | |
| 3,530,756 | A * | 9/1970 | Chapman | 84/726 |
| 4,058,045 | A * | 11/1977 | Jennings et al. | 84/731 |
| 4,084,473 | A * | 4/1978 | Kitashima et al. | 84/731 |
| 4,091,702 | A * | 5/1978 | Murakami | 84/744 |
| 4,142,437 | A | 3/1979 | Kakehasi | |
| 4,212,220 | A * | 7/1980 | Helpinstill, II | 84/726 |
| 4,478,124 | A | 10/1984 | Kikumoto | |
| 4,633,750 | A | 1/1987 | Sakai | |
| 4,760,767 | A | 8/1988 | Tsurubuchi | |
| 5,009,147 | A | 4/1991 | Yamamori | |
| 5,074,185 | A | 12/1991 | Nishikawa et al. | |
| 5,094,138 | A | 3/1992 | Otsuka et al. | |
| 5,138,926 | A | 8/1992 | Stier et al. | |
| 5,159,144 | A | 10/1992 | Fujisawa et al. | |
| 5,260,508 | A | 11/1993 | Bruti et al. | |

(Continued)

OTHER PUBLICATIONS

Lisa Greim Everltt, "A New Piano that Helps You Learn to Play", SimplyFamily—Where Families Come Together, http://www.simplyfamily.com/display.cfm?articleID=new_piano.cfm.

(Continued)

*Primary Examiner*—Jeffrey Donels
(74) *Attorney, Agent, or Firm*—Morgan & Finnegan LLP

(57) ABSTRACT

A high technology acoustic piano includes a piano body. A musical keyboard is mounted on the piano body. Keys are connected to the action for operating the hammers to strike strings. Strings adjacent to the hammers are arranged in different groups according to frequency, pitch, and ranges. A soundboard is mounted to the piano body and is spaced under the strings. Four or more pickups (located between the groups of strings and the soundboard) transmit frequencies, overtones and beats to onboard computers and to each pickup's separately controlled amplifier. An onboard computer mounts on the piano body near the musical keyboard and stores musical scores, written/drawn materials, and word processing text, and records music from the strings, pickups, modules, and amplifiers associated with the musical keyboard. A scanner slides from beneath the keyboard to copy printed/written/drawn materials and word processing text into the computer.

18 Claims, 10 Drawing Sheets

U.S. PATENT DOCUMENTS

| | | | | |
|---|---|---|---|---|
| 5,400,687 | A | 3/1995 | Ishii | |
| 5,760,323 | A * | 6/1998 | Romero et al. | 84/470 R |
| 5,789,693 | A | 8/1998 | Lawson | |
| 5,864,078 | A * | 1/1999 | Koevering | 84/478 |
| 5,908,997 | A | 6/1999 | Arnold et al. | |
| 5,990,409 | A | 11/1999 | Takahashi et al. | |
| 6,084,167 | A * | 7/2000 | Akimoto et al. | 84/477 R |
| 6,143,972 | A * | 11/2000 | Ladyjonsky | 84/615 |
| 6,147,290 | A | 11/2000 | Uno | |
| 6,156,964 | A | 12/2000 | Sahai et al. | |
| 6,160,213 | A * | 12/2000 | Arnold et al. | 84/615 |
| 6,175,074 | B1 | 1/2001 | Takahashi et al. | |
| 6,218,602 | B1 | 4/2001 | Davis et al. | |
| 6,288,313 | B1 | 9/2001 | Sato et al. | |
| 6,333,455 | B1 | 12/2001 | Yanase et al. | |
| 6,417,435 | B2 | 7/2002 | Chantzis et al. | |
| 6,476,304 | B2 * | 11/2002 | Uehara | 84/600 |
| 6,483,019 | B1 | 11/2002 | Hamilton | |
| D467,607 | S | 12/2002 | Yanase et al. | |
| 6,489,550 | B1 | 12/2002 | Takahashi et al. | |
| 6,762,358 | B2 | 7/2004 | Iguchi et al. | |
| 6,956,956 | B2 | 10/2005 | Kuratani et al. | |
| 7,030,312 | B2 | 4/2006 | Bruti et al. | |
| 7,141,729 | B2 | 11/2006 | Uno et al. | |
| 2001/0007220 | A1 * | 7/2001 | Koseki et al. | 84/615 |
| 2002/0046638 | A1 * | 4/2002 | Wright et al. | 84/477 R |

OTHER PUBLICATIONS

Coffee Shop Jazz, Windows World 98: The Future is Today, http://www.microsoft.com/misc/features/features_winf.htm.

David Van Koevering, Sela Ministries, http://www.selahministries.com/special-kingdom-resources-summit.html.

"A Piano with Everything", Music & Sound: Pianos Play it Again—Church Buyers Guide, http://www.christianitytoday.com/yc/8y3/8y3048.html.

* cited by examiner

MUSIC COMMAND CENTER

ACOUSTIC PIANO WITH MIDI SENSOR AND SELECTIVE MUTING OF GROUPS OF KEYS

BACKGROUND OF THE INVENTION

This application claims the benefit of U.S. Provisional Application No. 60/401,347 filed Aug. 7, 2002.

In conventional grand and upright pianos striking strings produces musical notes. In electronic pianos, sounds are produced from electronic sources. In some pianos, speakers combine sounds from an acoustic piano with an electric sound source.

Sheet music is widely used. Pianists place a folder or book of sheet music on the piano music shelf and turn the pages of the book in accordance with the progress of the music being played. Alternatively the player will have another person next to the piano to watch the music as it is played and turn the pages accordingly.

Scores can also be stored in memories and pages presented on display devices, which advances the display according to the playing position of the musician in reference to the actual score.

Need exists for improved acoustic pianos and integrating acoustic pianos with computers and new technology.

SUMMARY OF THE INVENTION

The present invention provides an acoustic piano with at least four pickups mounted between the soundboard and strings. Each pickup is adjusted to the frequency range of a group of strings. Amplifiers with separate controls mounted near the keyboard adjust volume and tone of individual pickup amplification systems and deliver the outputs to built-in speakers. At least two of the speakers face the performer, and preferably are rotatable to selected output directions.

An onboard computer stores music and scores. A music desk monitor displays music and text. A computer keyboard with music symbols mounted directly below the monitor may be used to change the score or add notations. A music-editing mouse or screen-pointing wand may be used with the monitor.

An instant page-turner pedal by the three standard piano pedals turns the pages shown on the monitor.

A telephone jack is mounted on the piano for connecting the piano onboard computer to Internet or music and score sites under the control of the computer keyboard. Pickup system output jacks are mounted on the piano for connecting the pickup system to external amplifiers and speakers.

The piano has a slide-out music scanner mounted beneath the keyboard, and the onboard computer has a CD burner and player and a MIDI Sound Module and sound source mounted beneath the keyboard in another location. A MIDI Sensor Strip mounted beneath the keys of the piano senses movement of the keys.

USB and serial connectors on the piano connect the piano-integrated computer to external computers, printers, and hand held computers. A mouse is positioned on a flat surface of the piano. A hard drive and battery pack are mounted under the keyboard of the piano. A remote control is provided to control each of the functions.

A high-technology acoustic piano has a piano body. A harp plate, pinblock, and soundboard are mounted on the piano body, a musical keyboard including keys connects to the action, hammers connect to the action, strings connect to the harp plate and are positioned adjacent to the hammers, strings are arranged in different groups according to principal frequency ranges and pitches, and a soundboard is connected to the piano body and positioned slightly under the strings. At least four pickups, respectively positioned between the soundboard and the different groups of strings pick up string vibration frequencies from the different groups of strings. Separate connectors severally connect the pickups to amplifiers to transfer sound through various speakers.

The connectors have jacks mounted on the piano body. The amplifiers and the speakers are mounted on the piano body, and at least two of the speakers are movably mounted as monitors on the piano body near the musical keyboard. Controls mounted on the piano body near the musical keyboard connect to the amplifiers and separately control tone and volume outputs of each pickup-amplifier combination.

A preferred embodiment of the present invention includes a flat panel display mounted on a music desk above the musical keyboard, and a computer connected to the flat panel display for storing musical scores as well as word processing files/documents and displaying them on the flat panel display.

A preferred high-technology acoustic piano has three conventional pedals connected to the piano body and a fourth pedal connected to the piano body and to the computer for advancing the displaying of musical scores on the display. The onboard computer is mounted on the body under the musical keyboard and stores musical scores and records music from the pickups, modules, components, and amplifiers.

In an embodiment of the present invention, the onboard computer has a removable hard drive, which is accessible near the musical keyboard. The onboard computer also has a coupled CD player and CD-RW burner.

Preferably, a computer keyboard is mounted on the piano body beneath the flat panel display and is connected to the computer for editing, changing and writing musical scores and adding notations on the scores. A mouse is positioned on a flat surface of the piano body near the musical keyboard for communicating with the onboard computer.

A preferred embodiment of the present invention has a music-editing wand for annotating, changing and editing musical scores on the display. A MIDI system is mounted on the piano body and connected to the onboard computer. The MIDI Sensor Strip is connected to the MIDI system and mounted beneath the keys to detect movements of the keys.

Preferably, a telephone connector jack on the piano body connects the onboard computer to the Internet. A scanner mounts on a slide connected to the body beneath the musical keyboard for scanning and storing musical scores as well as text/drawings/materials in the onboard computer. A piano battery pack mounts on the piano body and connects to the onboard computer, and to the amplifiers to supply them with power.

Preferably, a portable computer connects to the onboard computer by a computer connector or an Ethernet port and exchanges musical scores and notations as well as word processing files/documents between the portable computer and the onboard computer.

The present invention includes piano designs such as grands, uprights, and consoles. Two distinct forms are available, all acoustic or fully loaded computerized pianos. Pianos are built with the highest grade of materials that assist in accomplishing its pinnacle sound and technology. Not an electric piano, it is the first to bridge superior acoustic pianos with new technology that includes Computer Monitors, built-in Pickup Systems, Internet access, CD-RW drives, etc. The invention provides useful tools for pianists without compromising the integrity of the acoustic piano. Mindful of the traditionalist, each non-obtrusive component is color keyed with the finish of the piano and conveniently placed for easy access.

FEATURES AND NEW TECHNOLOGY

Scanner

The new piano comes with a state-of-the-art scanner that slides out from under the piano via remote control or manually. Users scan music, text, and drawings into the computer that will be displayed on the Music Desk Monitor computer screen. The brackets that hold the scanner can be adjusted to accommodate scanners that may differ in size.

Music Desk Monitor

The new Music Desk Monitor computer screen is touch sensitive. At a minimum, its viewable screen is large enough to display two 9×12 pages side-by-side simultaneously. An electronic eye is built into the screen to allow usage of the Remote Control. The computer can adjust larger or smaller pages to fit within the screen size. Smaller pages can be enlarged to display full scale without compromise to the grade of print when adjusted during scanning. To assure acute clarity, this maximum resolution Music Desk Monitor screen comes with several light adjustments to counter any lighting distractions. Green, blue, and white adjustable hues of color can be chosen as a backdrop for displayed music. These colors can be saved internally and/or saved on a CD via the CD-RW drive. For additional lighting adjustments, accessory slide-on visor barn doors can be fitted around the screen to defuse glare and sunlight. Even though the screen is made of durable scratch resistant material, a color keyed fitted cover is supplied as an accessory to slide over the Music Desk Monitor to guard the screen from scratches.

Sliding Grid

If the user would like to use sheet music on the traditional grid grooves, this can be achieved by sliding the grid over the typing keyboard. The Sliding Grid is concealed as a pullout, flush to the bottom of the music desk. The user can slide the grid back and forth over the typing keyboard as needed. The Sliding Grid can be moved manually or by remote control.

Instant Page Tuner Pedal

Where most conventional pianos come equipped with three pedals, the new pianos come with an additional pedal as a page turning device to complete the pedal trap as four functional pedals. The Instant Page Tuner pedal preferably is located as the first pedal on far left. Tapping the pedal once advances the page to the next and/or subsequent pages of music, while tapping twice reverts to the previous page and/or back pages. Holding down the pedal fast forwards pages. Tapping the pedal once then holding it down rewinds pages. Taking the foot off the pedal stops the page turning and displays the page where stopped.

Music Editing with Wand

Where there is certain music that requires the pianist to follow notations such as the D.S. and Coda repeat signs, the user can mark a red dot or highlight these signs with the supplied editing wand that is part of the piano's music editing system. As the user plays the piano, the computer automatically turns the pages in accordance to the red dots. The computer senses where the user is playing by the keys that are being pressed that coincide with the music displayed on screen, then turns the pages automatically so the user never has to take hands off the keyboard. Users can also set the computer to record and write notes onto music manuscript that coincide with the music being simultaneously played. The editing wand allows the user to add, change, and delete/erase certain notations, text, or marks on the pages. Also, users can mark/illustrate (write, draw, and edit) on the Music Desk Monitor screen with the wand, in various colors, in real time. The use can compose/write/draw onto several preinstalled music manuscript and scoring pages as well as blank pages. No marks will surface on the touch sensitive screen. The wand only transfers marks/illustrations into the page displayed, similar to an Etch-A-Sketch screen that is never marked. All work can be saved internally or saved onto a CD via its CD-RW drive.

Music Command Center

The new Music Desk Monitor computer screen is touch sensitive. The Music Command Center (MCC) is a feature that is activated by the editing tools to appear on the Music Desk Monitor computer screen. The MCC is superimposed over the existing music when activated by the editing tools. The focus density of the MCC can be adjusted to appear from transparent to solid clarity. The MCC is mobile and can be moved anywhere on the screen from top to bottom, left to right. When activated after first usage, the MCC will appear on screen where the user last placed it.

As an option to using the Instant Page Tuner pedal to change pages on the screen, the user can touch the BACK icon to revert to the previous page and/or back pages. Touching the NEXT icon advances to the next page and/or subsequent pages. Holding down the BACK icon rewinds pages. Holding down the NEXT icon fast forwards pages. Taking the finger off either icon stops the page turning and displays the page where stopped. Also, pages can be programmed to automatically turn via the computer's Music Sensor without use of the Instant Page Tuner pedal or by touching the touch sensitive Music Desk Monitor screen on the MCC. The Music Sensor locates where the user is playing in the music, then the Instant Page Turner turns each page accordingly. The user can also tap a measure anywhere in the music on any page to activate the Music Sensor. Tapping on a measure will indicate to proceed in the music from that measure.

Timing: Adjusting the Page Turning Timing

The user can adjust the timing of the changing incoming pages from slow fade-in to instant page turning, i.e., timing can be adjusted from 10 (fastest instant page turning) to 1 (slowest fade-in). From the last bar of music, back to the last 16 bars, can be assigned to remain on screen simultaneously while the next page of music appears on screen, so the user is able to read to the last note and then play the top of the next page of music seamlessly. The computer's Music Sensor locates where the user is playing in the music. If the user has started playing the top of the next page, the computer signals the last assigned bar(s) of the previous music to fade-out and to be replaced by the new page of music, if applicable.

This command can be repeated throughout the entire work of music. There is no limit of commands that can be assigned and activated separately or simultaneously. The MCC also has Menu Blocks that are used to navigate through the music and to signal the user when certain notations such as REPEAT, D.S. sign, CODA, TRANSPOSE and other internal assigned commands are near to activation. Each Menu Block can be assigned to flash 1 to 16 bars prior to activation as notice to the user. The Music Sensors locate where the user is playing in the music, then the computer transfers the information to the Menu Blocks to notify the user of the assigned commands. Each Menu Block can store multiple commands and can be assigned in sequence: (a.) when to appear, and (b.) when to activate the command. As an example of options, the user can assign Menu Block #1 to REPEAT bars 16 through 32 for 2 times, #2 to go back to the TOP of music after bar 56, and TRANSPOSE music from the key of C to a ½ step up to the key of C# (or any other interval), and Menu Block #4 for the music to jump to the last 16 bars when taking the CODA sign. Once the commands are set, the user can click the Music Command Center's icons off the page by tapping the OFF button. If the bars are not numbered, the user can touch the bars that need to be assigned. Those touched bars will highlight in color and will be assigned a desired bar number to form connected measures in succession or to rearrange the order of the music, i.e., assigning the music to start with the bridge instead of its original intro of music.

Single bars or groups of bars can be highlighted to be 'cut and pasted' into another part of the music. Also, bars can be deleted, and bars from other sources of music can be inserted into the existing music on screen. The user can also touch the Menu Blocks to command a function at certain programmed bars, or the user can command the music to activate a function instantly when touched, i.e., functions such as TRANSPOSE, back to the TOP, REPEAT, etc. The multilingual editing tools software allows the user to choose from the numerous preinstalled languages to display in the Menu Blocks. All commands can be saved internally and/or saved to a CD via the built-in CD-RW drive.

MagnaVizion

From the Music Command Center, the visually impaired user can activate the presently named MagnaVizion feature that displays a simulated magnifying lens that can be placed over any desired portion of music for enlargement while the remaining page stays intact. The user can assign certain measures or all of the music to be enlarged to desired proportions. The user has the option to program the magnifying lens to flow across the music with 1 to 4 measures enlarged ahead of each read measure, or program to allow assigned measures to magnify instantly without the lens on screen. A normal size measure can be enlarged to fill a full-page size. MagnaVizion allows the user to enlarge from 1 up to 16 consecutive measures. These measures can be programmed to display music in consecutive sequences in seamless flowing groups, i.e., enlarge every 2 measures, every 4 measures, every 6 measures, every 8 measures, etc., up to 16. The Music Sensor will locate where the user is playing, then trigger the Instant Page Tuner to turn the pages as programmed. Total voice interaction can navigate the visually impaired user through all features and commands of MagnaVizion. Each measure and/or text can be customized to the user's viewing preferences. The user can record and save all activity and settings without having to continuously set up customized enlargement functions each time of usage. The user can then save the preferences internally or burn a copy onto CD via the CD-RW drive. Because the new piano is interactive, the visually impaired user can activate all functions through its voice command. When the user commands a certain function to activate such as 'Trumpet Sound #2' from the MIDI Sound Module to play on the musical keyboard, the computer will beep to notify the user that the activation is complete. A buzzing sound will notify an activation failure. The interactive voice will explain the activation failure and then guide the user to achieve the desired function.

PianoInteract

PianoInteract, a feature of the Music Command Center, can understand, react, correspond, and implement voice commands when the user is speaking into a headset or near the built-in microphone located on the bottom of the computer screen. The user can activate features on the new piano such as instant page turning, modulations, repeats, module sounds, pickup system, Internet activity, music editing, reading emails, reciting lyrics, etc. With PianoInteract, the user can create, compose, arrange music, and surf the Internet without typing. The user can speak normally and dictate up to 160 words-per-minute accurately. PianoInteract will speak back to the user, corresponding and implementing commands. It will even question and/or explain the process of each command. As in MagnaVizion, each completed activity can be programmed to notify the user of a successful activity with a beep, or a buzzing sound for activity failure. This is a helpful feature for composers who desire to translate music without using the musical keyboard. This is also a helpful feature for the visually impaired user along with other features noted in MagnaVizion.

When composing, the user can say into the microphone; "Treble clef—GO, measure 1—Go, in 4/4 time—GO, 'G' half note on line 2—GO, quarter rest—GO, 'E' quarter note on line 1—GO, NEXT MEASURE—GO, C-E-G triad whole notes—GO, NEXT MEASURE—GO, G7 chord on line 2—GO; (G-B-D-F notes will automatically form the chord from line 2 to complete the G7 chord)." Saying "Inverted" or "1st inversion" will cause the G7 chord to form: B-D-F-G. PianoInteract will invert chords from 1st to 13th in major, minor, diminished, and augmented inversions. Musical notes, accidentals, lyrics, and text can be commanded to write over the entire grand staff including all leger lines and spaces.

PianoInteract will keep track of each measure being composed and will speak to the user to notify each measure that is being worked on, i.e., "You are now working on Measure 5." PianoInteract will playback a commanded measure(s), i.e., "Playback measure 3." It will also spell out each activity in a measure(s), i.e., "Measure 1 includes treble clef, (beep), 4/4 time, (beep), 'G' half note on line 2, (beep), quarter rest, (beep), 'E' quarter note on line 1 (beep)."

PianoInteract includes interactive/corresponding teaching tutorial software that instructs the user on how to play the piano at various playing levels (beginner to advanced/professional) in numerous styles. A metronome is included in PianoInteract with the standard 'click' as well as several beats, rhythms and meters. PianoInteract will keep records of documents/files and will instantly activate them by command. The built-in calendar will keep accurate records of practice and performance schedules.

PianoInteract allows the computer to understand what the user is saying. With thousands of musical terms preinstalled, the commands are only a naturally speaking audible command away from instant activation. The user can also create new musical terms and save them internally. PianoInteract will create text-to-speech and vice versa.

Preinstalled interactive languages include English, Japanese, Spanish, German, Chinese, Korean, Italian, French, and certain Slavic dialects. Other languages can be ordered on a CD or downloaded from a web site. It can also instantly translate these languages for text, music terms, lyrics, etc. This important feature allows the user to instantly correspond live in real time with students, teachers, musicians, and conferencing worldwide—online as well as offline. PianoInteract will also allow user's to chat with others online while playing the piano, sending music and text via the Internet while chatting simultaneously for ongoing discussions. Connecting the video cam to the USB port will allow users to communicate and see each other when they are online.

Contents

The user can tap the activated PianoInteract icon on the touch sensitive Music Desk Monitor screen for total voice command interaction (using the mouse manually is optional). The user can vocally select the "Contents" which encompasses all features and functions. A listing of all features will then display on screen.

Instructions

PianoInteract offers user/friendly visual and voice navigational instructions on how to operate all facets of the piano. The user just simply asks for "Instructions." The user can select instructions/descriptions for all features and functions or for each listing individually. The user can also select the Interactive Video Manual to view all components, modules, and total functions/features of the piano. The Interactive Video Manual will interact and correspond with questions/answers on how to operate the piano while simultaneously displaying video illustrations that coincide. The user can adjust the size of the video (i.e., picture-in-picture) to be able to implement the instructions in 'real time' as they are given. Categories of basic, intermediate, and advance are available levels of instructions with in-depth capabilities of the piano. Users can also connect to the Internet for additional live technical support, as well as download new features into the piano computer.

Piano Security

For security, PianoInteract includes locking codes, pass codes, and detects speech and voice recognition to activate its components. When the security lock is implemented, only the acoustic piano is functional. No computerized components, monitors, modules, etc., or otherwise are operable, however, all features can be selected a la carte to function without the remaining features being activated. For example, the built-in Speaker Monitors, Pickup System, and Jack Plug can be activated exclusively without other features being operable.

When the piano power is turned on, PianoInteract is automatically in effect, however, no component will be activated until the user taps the small PianoInteract icon on the bottom of the Music Desk Monitor screen. The Music Desk Monitor will not be lighted. Only the icon will appear. If the piano is in 'lock mode,' the user will have to play certain saved piano key combinations on the piano for activation. The user can play up to any 12 key combinations, using all octaves as the password, i.e., C1, G2, Eb7, F#6, A5, D4, etc., then tap the icon. Once the password is accepted, the Music Desk Monitor will light for access. If the master user set the piano for limited access, i.e., only the built-in Speaker Monitors, Pickup System, and Jack Plug are activated, then only those features will be operable. The piano can be set up to allow several locking codes. These codes can be programmed to allow limited or full usage of the new piano for certain individual users.

Sequencer

The computer has a built-in sequencer with at least 16 recordable tracks with features including: MIDI system, MIDI ports, jack-in and jack-out plugs. The sequencer allows the user to record unlimited notes into the computer, adjust the value of each note, quantize each note and/or entire work, and save internally and/or onto CD via the CD-RW drive. Music can be recorded in 'Sympte' or other 'time codes.' The computer will also allow the user to upgrade the sequencer as well as install other music composing and sequencing software of choice.

Computer/Typing Keyboard

The computer is functional and operational as any conventional computer but with numerous exclusive features. Users can compose, edit and read typed or scanned lyrics/text on the screen. The computer offers the most powerful updated versions of PC and Macintosh operating systems. Both systems can exist in full function simultaneously. Users can open each document/file then burn it onto a CD via the built-in CD-RW drive. The computer comes with Ethernet, FireWire, and USB connections. Users can title and file all music and text by using the typing keyboard that is located at the bottom of the Music Desk Monitor screen and save information onto a CD via the built-in CD-RW drive or in the piano's computer.

Mouse

Even though this mouse is operated the same as any standard computer mouse, this mouse will include features that are new and exclusive to the new piano. This mouse allows the user to highlight certain lines, measures, sections, or the entire music work to be sent to print, i.e., selecting line #3—the 4th trumpet part, and then send it to print. The computer will send information to the printer to print the music in seamless sequence. Music will be printed as consecutive connected measures—line-by-line as standard manuscript sheet music.

MIDI Sound Module

An equipped MIDI Sound Module has over 300 useful digital sounds to play simultaneously with the acoustic piano or play exclusively without the sound from the acoustic piano. Users can create, enhance, replace, and edit these preinstalled digital sounds as well as edit additional sounds that can be downloaded into the MIDI Sound Module. Also, sounds can be downloaded into the computer then downloaded into the MIDI Sound Module and vice versa. Additional MIDI sound devices can be connected through the MIDI inputs/outputs. The touch sensitive MIDI Sensor Strip, located under the piano keys, allows the user to trigger sounds that coincide with each pressed key. The module also has headphone and microphone jack plugs. The Pitch Bend and Modulation Levers, located on the front left Side Block, allows users to alter real-time sounds from the module such as ascending/descending pitches, and pitch/notes vibrato. Adjustable stereo digital effects such as reverb and chorus are also included in this high-tech module.

Octave Buffer

Sounds from the MIDI Sound Module can be played exclusively without hearing the acoustic piano when the Octave Buffer is applied. In each octave, the user can choose to play all acoustic piano or play acoustic piano simultaneously with MIDI Sound Module sounds. Also, the user can assign various options to each octave, i.e., the user can choose to play only synthesizer bass in the 1st octave (with Octave Buffer ON), only horns in the 2nd octave (with Octave Buffer ON), only acoustic piano in the 3rd octave (with Octave Buffer OFF—no assigned sounds from MIDI Sound Module), only strings in the 4th octave (with Octave Buffer ON), and acoustic piano and organ simultaneously in the 5th octave (with Octave Buffer OFF—with assigned sounds from MIDI Sound Module). The Octave Buffer is preferably located in several locations to mute the sound of the acoustic piano; (a.) along the side of the Continuous Bridge, which includes bass/tenor/alto/treble sections; (b.) attached continuously along the Damper Guide Rail block; (c.) buffers that go between hammers and strings.

When the Octave Buffer is ON, the loud pedal then becomes a sustain pedal for the sounds in the MIDI Sound Module. The buffers will not affect or change the feel of the hammer striking the string; consequently the touch of the piano will not be altered. The user will feel as if they are still playing the acoustic piano even when triggering the sounds from the MIDI Sound Module. The Octave Buffer is activated and controlled by the MIDI Sound module. Easy access press buttons on the module allows the user to quickly activate all or selected different sections of the piano to be muted/un-muted by the Octave Buffer.

Pickup System

The new piano has at least four pickups that are strategically placed on the most vibrant locations on the soundboard to transcend the optimum sounds of the piano (1 bass, 1 tenor, 1 alto, 1 treble). The Pickup System control module, located on the front of the piano, can electronically control the tone of each pickup individually via its graphic equalizer and is designed to reproduce music naturally, clearly, and dynamically with spatiality. When more bass is desired, the user can press the bass button, then the equalizer options will appear on its screen to create the various bass timbers desired (deep bass, mid-range, high-end bass, top peak, etc.) from 1 (deep bass) up to 10 (top peak). The same options apply to the remaining pickups. The Pickup System's graphic equalizer allows the user to achieve a desired sound by adjusting each section's pickup, i.e., from lowest bass, to midrange, to highest treble, as well as the various semi-tones in between. Also, volume for each pickup can be controlled individually from 1 (soft) to 10 (loud).

Once the user achieves the desired sound through adjustments on the pickup system module, these settings can be saved internally in the pickup system module and/or burned onto a CD via the built-in CD-RW drive. The user can save the desired volume, tone, and all music documents/files onto a CD and load it into any similar piano's CD-RW drive. The piano will automatically adjust in accordance to the settings on the CD.

On the front of the Pickup System module is a mute button that is used to instantly turn down the volume. Volume from all components, amplifiers, modules, and speakers will shut off when the mute button is pressed. The sign 'MUTE' will appear on the LED panel. The user can press the mute button a second time to regain the previous volume, and the "MUTE" sign will turn off.

Built-in Speaker Monitors

The pickups and the Pickup System transfers sound to two built-in speaker monitors. These adjustable rotating speaker monitors are located on the front of the piano (one on each side) to assist the user in hearing the richness, tone, and volume of the piano sound. These sophisticated speakers are designed to deliver the sound of the piano, not the sound of the system. The objective is to transcend, enhance, and accentuate the actual sound generating from the piano. These speakers will envelop the user with a realistic feel of three-dimensional space that surrounds and transports sound. These correctly balanced compact speakers can duplicate the volume and tone of much larger speakers, with a design to separate treble, midrange, and bass with pure lucidity and spatiality—flowing effortlessly from whisper to roaring without strain or distortion. Whether at low volume or high volume, these speakers have the capacity to deliver the heaviest of bass and the highest of treble at low volumes. Volume does not impede the tone delivered through the speakers. Programmed tones of heavy bass or high treble will remain prominent from high volume settings to off.

Jack Plug

For additional amplification, the piano is equipped with an output jack plug. Presently, a quarter inch jack cord can be used to connect the piano to amplifiers, monitors, speakers, P. A. systems, etc. Also, the new pianos come with accessorized wireless antenna system attachments, using similar equipment as wireless guitar and microphone systems. A wireless attachment is plugged into the piano. The signal from the piano is sent to the main base wireless unit to achieve additional amplification.

Telephone Jack

The new pianos are the only pianos wired for the Internet. A telephone jack is preferably located on the side of the piano. For Internet access, one end of the telephone cord is plugged into the jack on the piano. The other end is plugged into a live telephone wall jack. The new pianos have accessorized wireless antenna system attachments. The signal from the piano is sent to the main base wall wireless unit, from where it may be further transmitted over the Internet. Users can send and receive music over the Internet just like any conventional computer but with additional exclusive highlights, i.e., the user can email recorded and printed music for end-user to open—listen and read, record sequenced or un-sequenced music and send it as 'Sympte' or 'time coded' music to be used as actual recordings, and purchase online music and download it instantly as actual manuscript music.

Palm Pilot

Users can use a Palm Pilot to compose music then download information into the piano computer via the USB port and save it.

Remote Control

Even though the electronic components can be operated manually, the new piano comes with a remote control. The remote control can operate the MIDI Sound Module, Pickup System module, CD-RW drive, Music Desk Monitor screen (which includes controlling all contents in the computer), scanner, etc.

Battery Pack

A battery pack is used to power all AC components on the piano as an option to standard AC units such as wall plugs, sockets, generators, etc. The battery pack can sustain all electronic functions on the piano for a minimum of 3 hours.

Hard Drive

A portable hard drive is insertable and removable from the on board computer and allows users to transfer, download and save information from the new piano as well as from other computerized sources.

The Amplifier

The new piano amplifier offers at least a powerful 50-Watt amplifier to run all the electrical components on the new piano. This built-in amplifier includes anti-feedback filters that reduce unwanted feedback to help deliver clean and precise natural tones. An internal limiter ensures maximum output while the sound remains distortion free. Unlike amplifiers that are designed for electric pianos and guitars, the new amplifier is intensely designed for the wide array of various tones and pitches of an acoustic piano. This amplifier, coupled with the pickups, translates accurate timbres from the soundboard that are independent of pitch and volume. The new amplifier has at least four ¼ inch jack inputs, affording independent volume and EQ controls for each pickup, and at least four RCA channels for external audio equipment such as the MIDI Sound Module. Even though the new 50-Watt amplifier offers more than enough power for typical music venues, a ¼ inch line-out jack on the piano allows connectivity directly to external PA systems, monitors, and additional amplifiers for more volume.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
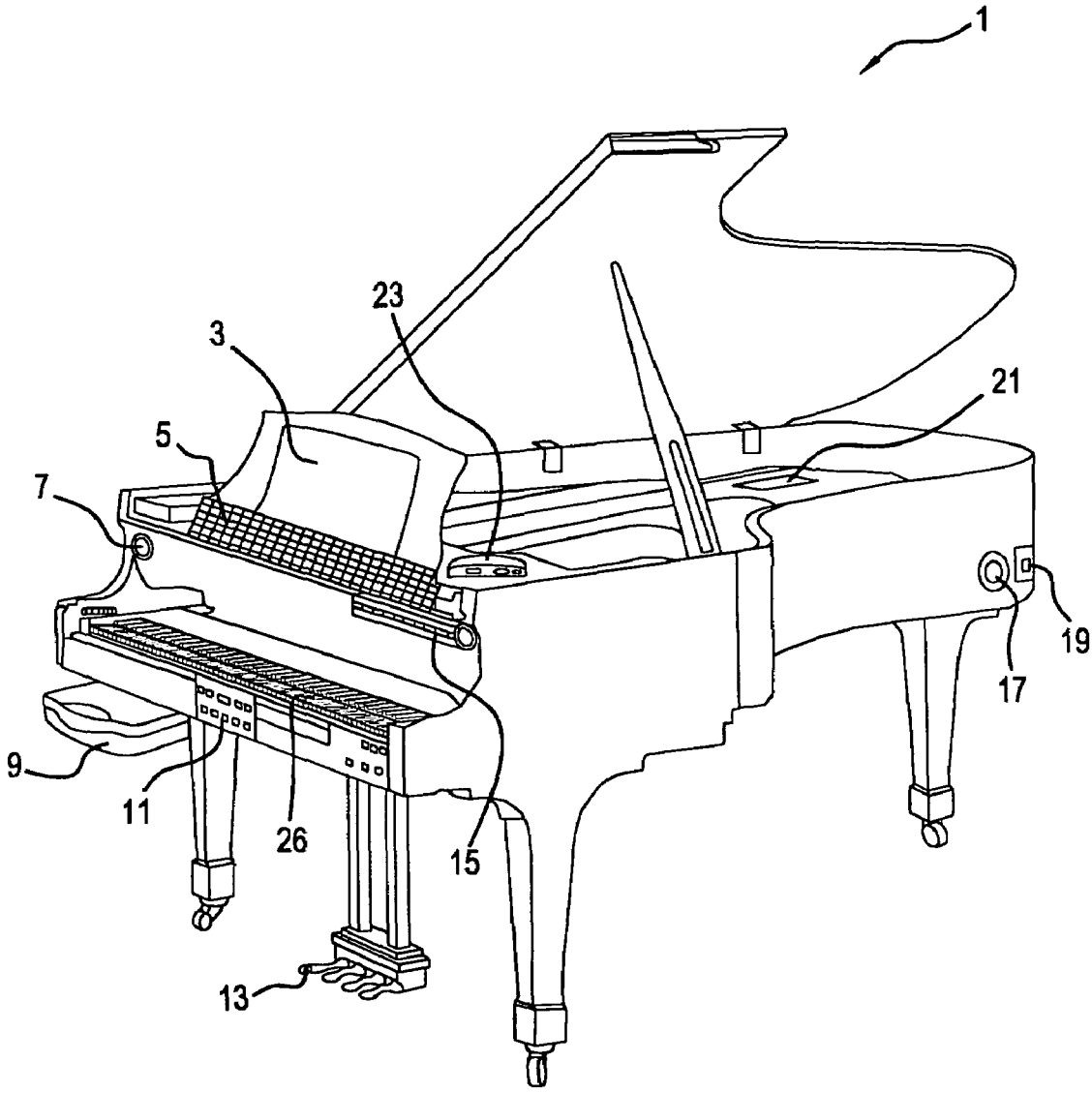
FIG. 1 is an embodiment of the present invention using a grand piano, showing a slide out scanner, computer, speakers, monitor, page advancer, and controls.
Figure 2:
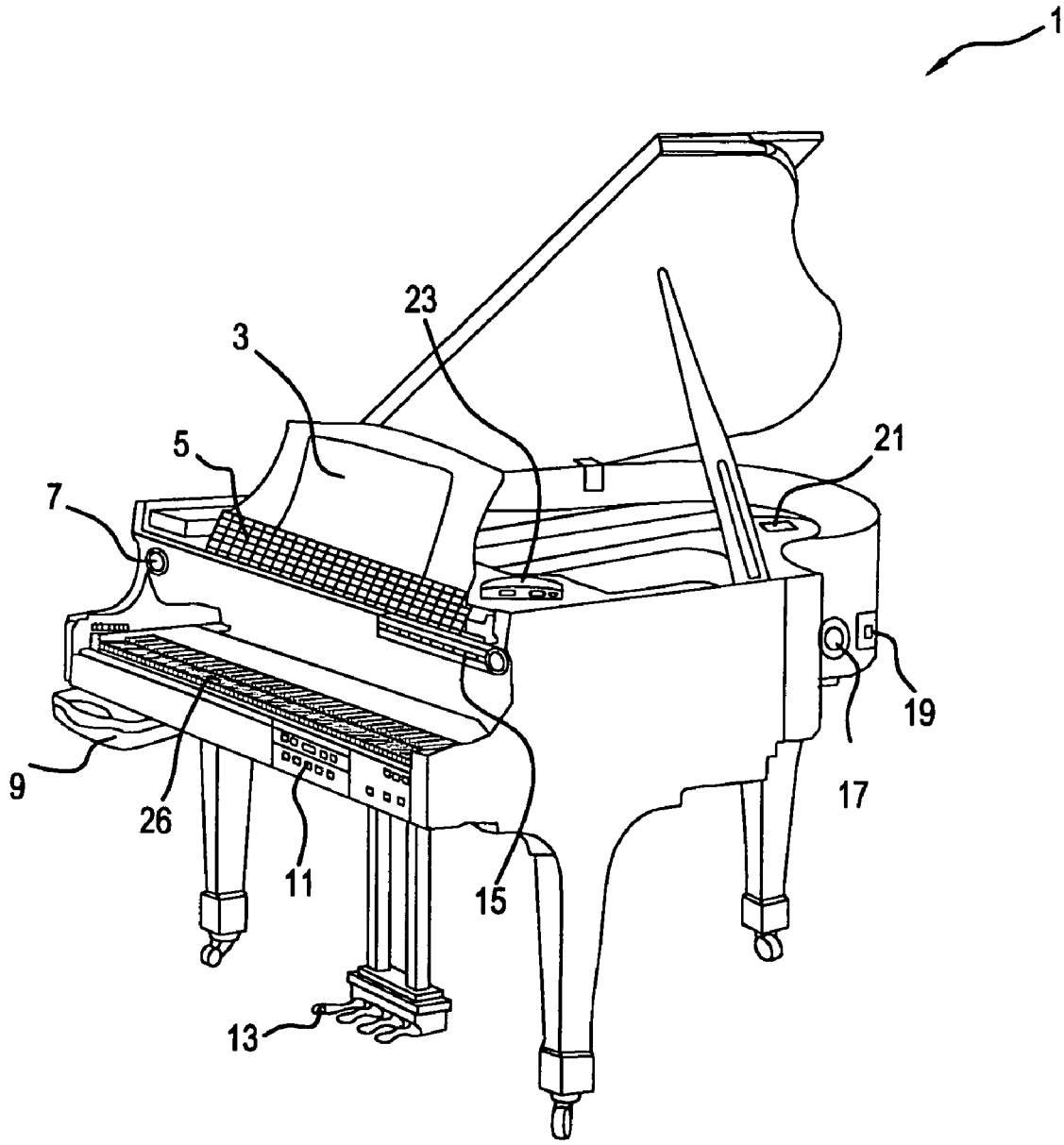
FIG. 2 is an embodiment of the present invention using a baby grand piano with similar additions.
Figure 3:
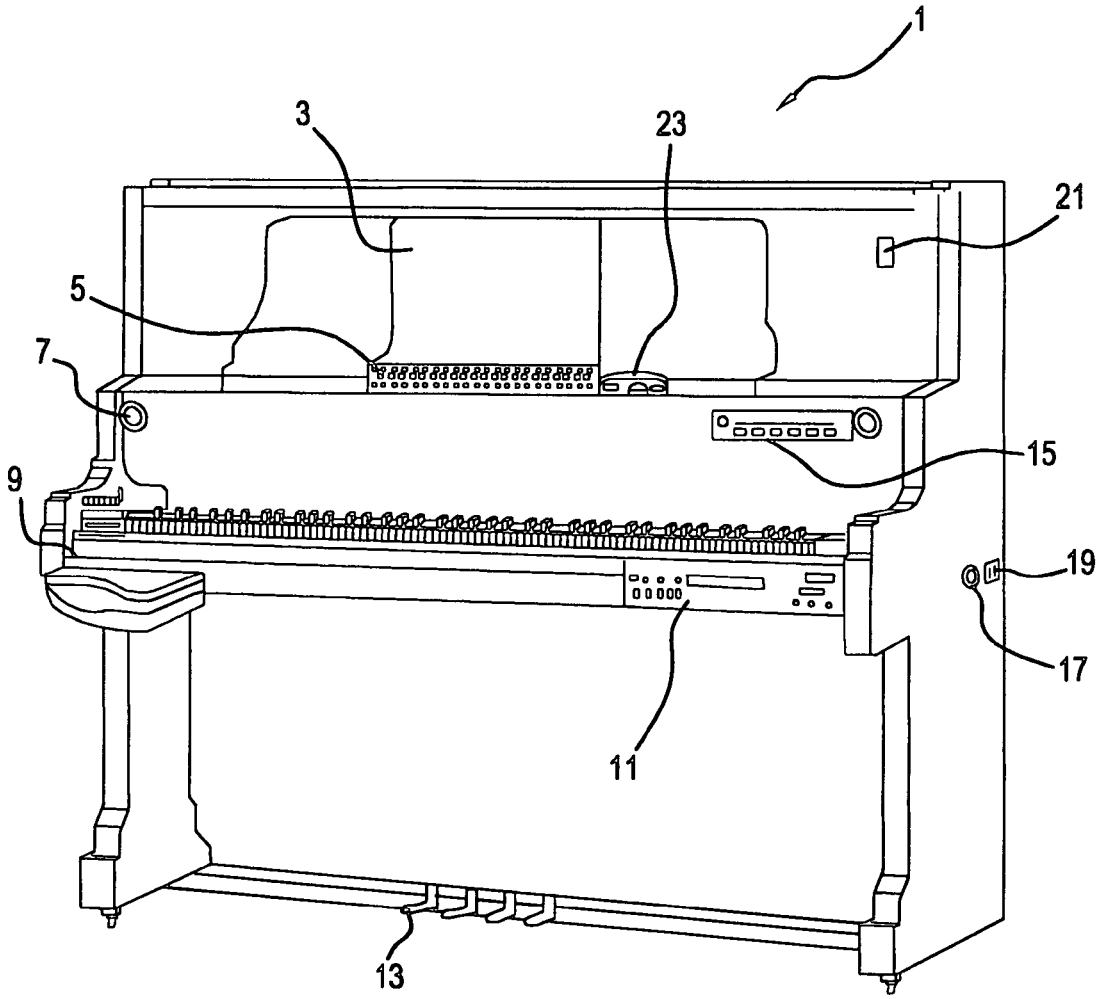
FIG. 3 is an embodiment of the present invention using an upright piano with similar additions.

Referring to FIGS. 1-3, the present invention is a high technology acoustic piano 1, in varied forms, grand (FIG. 1), baby grand (FIG. 2) or upright piano (FIG. 3). The high technology acoustic piano 1 has a music desk monitor 3 and a sloped computer input keyboard 5 and mouse 23. The music desk monitor 3 has a built-in computer monitor screen that displays manuscript, sheet music, word processing text, Internet and editing tools. A music desk monitor 3 has several light adjustments to counter any lighting distractions. Music is displayed very clearly and decisively on a computer display or flat panel television screen. A computer keyboard 5 is used to type in music symbols, word processing text, as well as domain and screen names for Internet access through a telephone jack 19.

Built in speakers 7 help pianists hear the music they are playing. Speakers are built into the left and right sides of the fallboard and each speaker is adjustable: face-in and full circle rotation toward the pianist, to extreme left and right angles. Speaker volume levels are adjusted with pickup system controls 15. The Pickup System has at least four strategically placed microphone pickups 21 are mounted on the soundboard or between the soundboard and the strings to enhance volume and tone. Pianists adjust the volume and tone of each pickup separately with at least four LED controls 15. Buttons located on the front of piano cause the onboard computer to save internally or burn a CD with a CD burner/drive/player is located on a MIDI Sound Module 6. A jack outlet 17 can connect the piano 1 to external amplification by using a ¼ inch jack cord or an onboard built-in wireless system.

The CD burner/drive/player 11 of the MIDI Sound Module 6 allows the user to burn music onto CD's via the built-in CD-RW player 11. Users can connect a slide mounted piano scanner 9 to the computer to scan music and text to display on the music desk monitor computer screen monitor 3. A MIDI Sensor Strip is mounted under keys 26 to trigger MIDI sounds that can be saved internally in the MIDI Sound Module.

Also, internal sounds can be edited to create new sounds, and external sounds can be downloaded and edited; both can be saved internally and/or burned onto CD. Each piano key is touch sensitive. The user can trigger sounds and effects from other peripheral MIDI devices or sequencers when they are connected to the piano's MIDI system. These sounds and effects can be played simultaneously when the user is playing the musical keyboard. The MIDI system also allows piano labs and music schools alike to connect multiple high technology acoustic pianos together.

State of the art scanning is achieved by manually sliding the piano scanner 9 out from under the left side of the piano 1 or by pushing the remote control's 'forward' button. After scanning, the piano scanner 9 is manually returned neatly back to its inconspicuous position. This return task can also be accomplished by pressing the remote control's 'back' button.

An Instant Page Turner allows the pianist to press an additional fourth pedal 13 or a button on the floor that instantly changes the existing music displayed on the screen to subsequent or previous pages of music. This system is advantageous because concert pianists often depend on an assistant to turn pages if music scores are needed.

The present invention provides a high technology acoustic piano wired for the Internet. The piano has a phone jack connector 19 and cord that connects into a wall phone jack, which makes the piano and the onboard computer totally active for sending and receiving music, and files/documents over the Internet. Wireless information can be transferred as well. Worldwide users can send and receive music instantly to be displayed on the Music Desk Monitor computer screen. Music teachers can send and receive music lessons and interact in real-time with students via the Internet. Live shows can send and receive music instantly. Users can purchase music from Internet music vendors/sources and display the music instantly on the Music Desk Monitor computer screen. The computer saves music, word processing, text, and files/documents.

Embodiments of the present invention uses a hard drive, palm pilot, remote, music editing wand, piano battery pack, and a MIDI Sensor Strip. Options include magnification of screen images for visually impaired users, voice activated systems, computerized navigation of contents, instructions for use and security systems to limit use of the high technology piano. Users can create and edit music on a palm pilot that consists of music composing capabilities, manuscript, and editing tools. The user can then transfer information to the high technology acoustic piano computer. All information can be saved and/or burned onto CD.

The present invention also allows utilization of a piano battery pack. The battery pack is powerful enough to run all electronic features and be fully functional for hours. Amplified sound projects from the built-in speaker monitors and/or connected external speakers.

A portable removable hard drive can be transferred from the high technology acoustic piano computer to connect to a user's PC or Mac computer directly or via a USB cable. The portable hard drive does not require any external power source so no AC adapter or batteries are needed.

Figure 4:
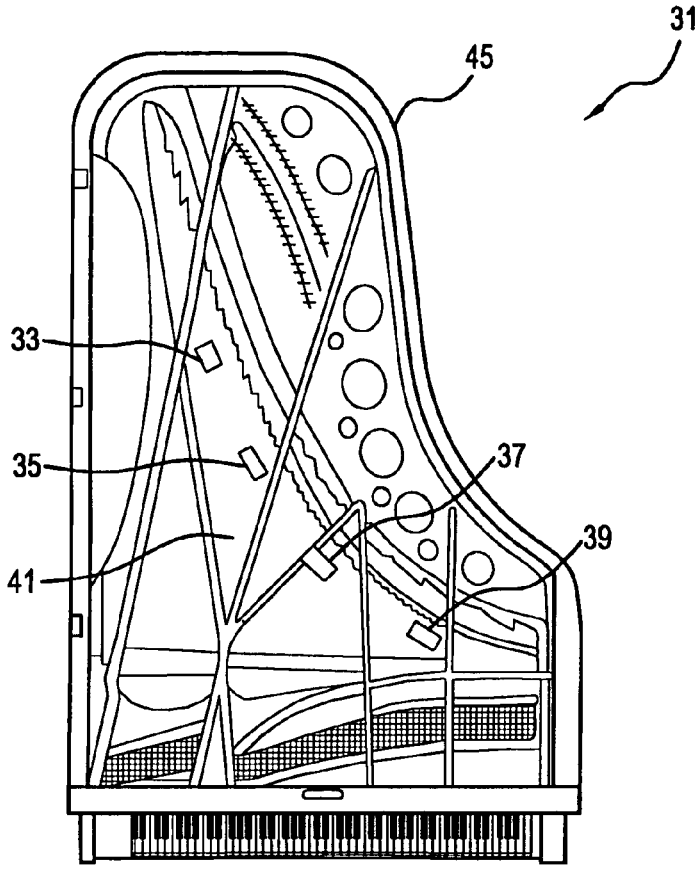
FIG. 4 shows the present invention pickup system in a grand piano.

Referring to FIG. 4, a grand or baby grand high technology acoustic piano 31 has four strategically placed microphone pickups 33, 35, 37, and 39 on the soundboard or between a soundboard 41 and the strings to enhance volume and tone. The user can adjust the volume and tone of each pickup separately with at least four LED control buttons located on the front of the piano and then can save the sounds internally or burn them onto a CD. The jack plug connector 17 shown in FIG. 1 can connect the piano to external amplification by using a ¼ inch jack cord, also connect the jack plug connector to external amplification by using its built-in wireless system in a piano 45.

Figure 5:
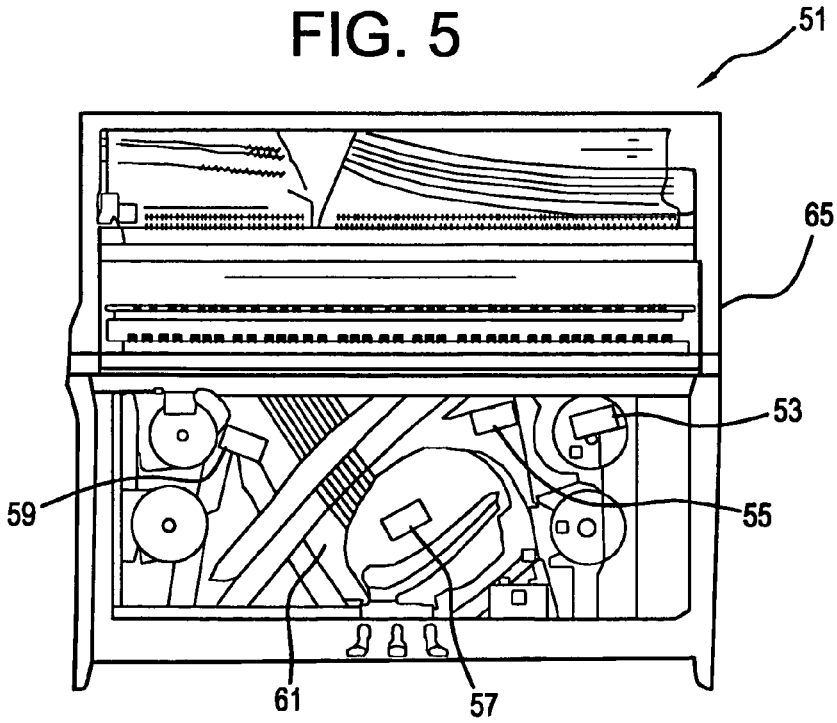
FIG. 5 is a front-view photograph of the present invention pickup system in an upright piano.

FIG. 5 shows placement of the pickup system in an upright high technology acoustic piano 51. At least four strategically placed microphone pickups 53, 55, 57 and 59 are on the soundboard or between the strings and a soundboard 61 to enhance volume and tone. The user can adjust the volume and tone of each pickup separately with at least four LED control buttons located on the front of the piano and then can save the sounds internally or burn them onto a CD. The jack plug connector can connect the piano to external amplification by using a ¼ inch jack cord, also connect the jack plug connector to external amplification by using its built-in wireless system in the piano 65.

Figure 6:
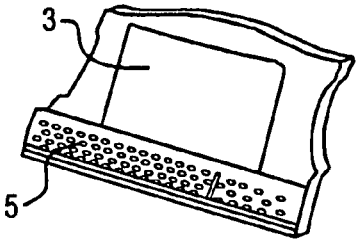
FIGS. 6-26 show elements of the high technology pianos of the present invention.
Figure 7:
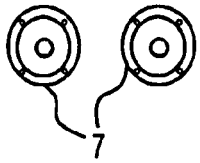
Figure 8:
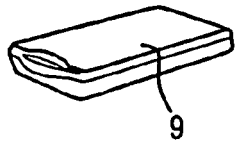
Figure 9:
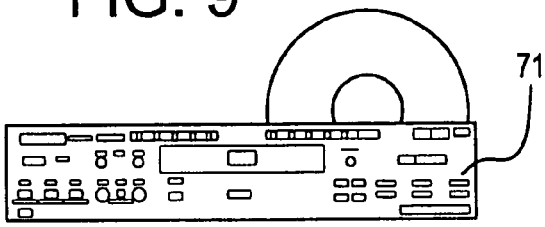

FIG. 6 shows details of units connected to the high technology piano. An adjustable computer keyboard 5 is mounted near a computer monitor screen 3. Music Desk Monitor 3 is placed against the music desk in front of the user. Built in speakers 7, shown in FIG. 7, are placed in the front of the piano with one speaker placed on the left side and one speaker placed on the right side of a grand piano. The piano scanner 9, shown in FIG. 8, is mounted on a slide beneath the left side of the musical keyboard. A computer with a hard drive and ram, has a player, a CD burner, a MIDI Sound Module 6 and a sound source 71, as shown in FIG. 9, mounted beneath the right side of the musical keyboard. A fourth pedal 13, shown in FIG. 10, operates a page-turner system 14. A pickup control system that controls each pickup and groups of pickups 73, shown in FIG. 11, is mounted in the front, near or on the fallboard of the piano.

Figure 12:
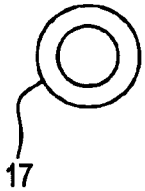
Figure 13:
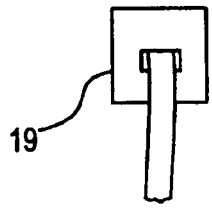
Figure 14:
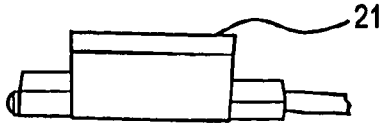
Figure 15:
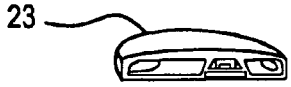

A sound system jack 17, shown in FIG. 12 is mounted on a side of the piano. A telephone jack connector 19, shown in FIG. 13, is mounted on a side of the piano for connecting the computer to the Internet. At least four pickups 21, shown in FIG. 14, are mounted under the strings. A mouse 23, shown in FIG. 15, is placed on a flat surface of the piano near the music desk.

Figure 16:
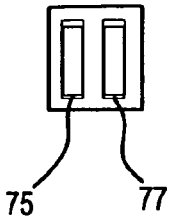
Figure 17:
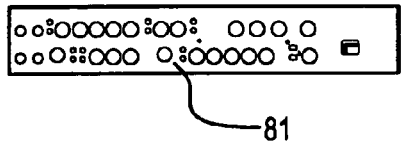
Figure 18:
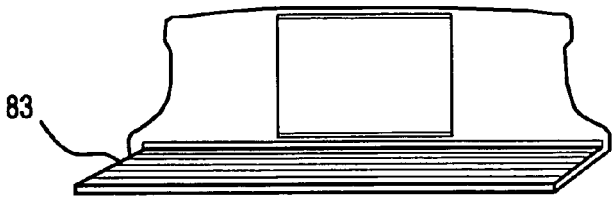
Figure 19:
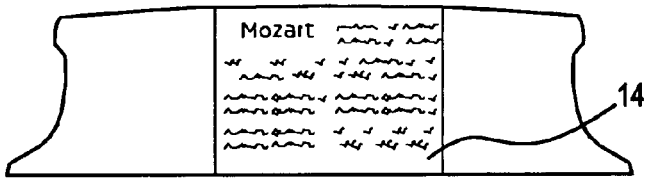

Pitch Bend and Modulation Levers 75, 77 are mounted in a housing 79, as shown in FIG. 16, are mounted on the front, at the left side of the musical keyboard. A built-in amplifier 81, shown in FIG. 17, is mounted beneath the musical keyboard. At least four pickups 21, shown in FIG. 14, are mounted under the strings. A sliding grid 83 covers the computer keyboard, as shown in FIG. 18. A page-turner system 14 is shown in FIG. 19.

Figure 20:
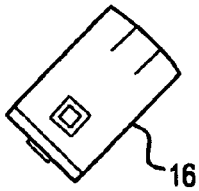
Figure 21:
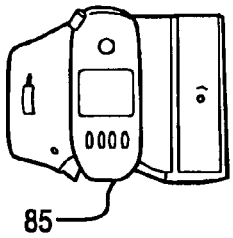
Figure 22:
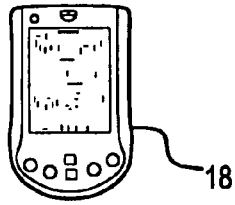
Figure 23:
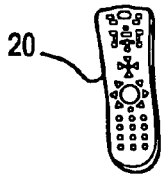
Figure 25:
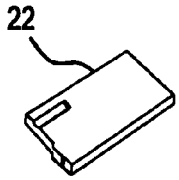
Figure 26:
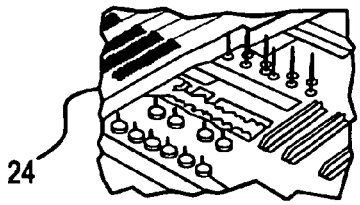

A removable hard drive 16, shown in FIG. 20, slides into the computer 85 in FIG. 21. A Palm Pilot 18, as shown in FIG. 22, or other handheld computers, are connected to the computer through USB ports. A remote control 20, shown in FIG. 23, operates the pickup control system, sliding grid, scanner, MIDI Sound Module, 73 controls 30 and a computer 85. A music-editing wand 28 is used with the touch sensitive Music Desk Monitor computer screen 3, shown in FIG. 24, for inputs. A battery pack 22, shown in FIG. 25, is mounted beneath the musical keyboard. A MIDI Sensor Strip 24, shown in FIG. 26, is mounted under the keys.

Scanner

The new piano comes with a computer and a state-of-the-art scanner that slides out from under the piano by remote control 20 or manually. Users scan music, text, and drawings into the computer that will be displayed on the Music Desk Monitor computer screen 3. The brackets that hold the scanner can be adjusted to accommodate scanners that differ in size.

Music Desk Monitor

Figure 27:
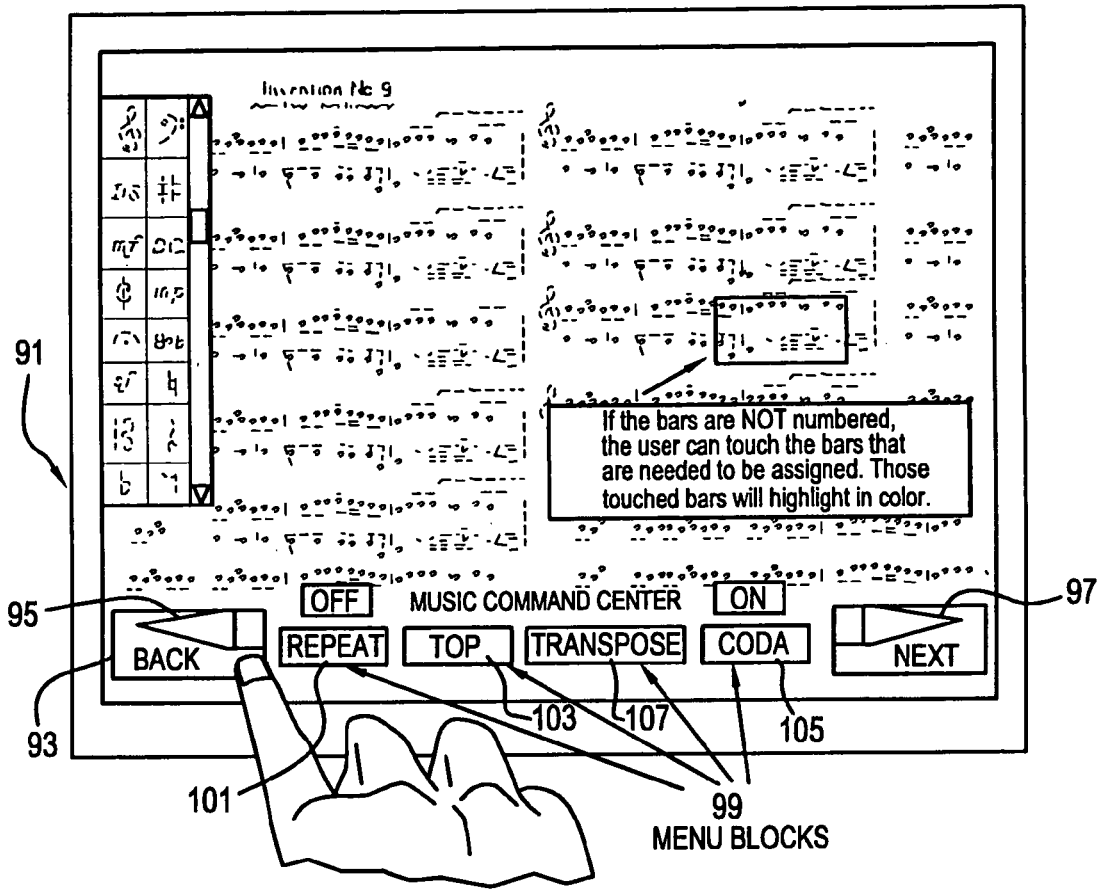
FIG. 27 shows a music command center.

The new Music Desk Monitor computer screen 3, shown in FIG. 27, is touch sensitive. At a minimum, its viewable screen is large enough to display two 9×12 pages of music side-by-side simultaneously. An electronic eye is built into the screen to allow usage of the remote control 20. The computer can adjust larger or smaller pages to fit within the screen size. Smaller pages can be enlarged to display full scale without compromise to the grade of print when adjusted during scanning. To assure acute clarity, this maximum resolution music desk monitor screen comes with several light adjustments to counter any lighting distractions. Green, blue, and white adjustable hues of color can be chosen as a backdrop for displayed music. These colors can be saved internally and/or saved on a CD via the CD-RW drive. For additional lighting adjustments, accessory slide-on visor barn doors can be fitted around the screen to defuse glare and sunlight. Even though the screen is made of durable scratch resistant material, a color keyed fitted cover is supplied as an accessory to slide over the Music Desk Monitor to guard the screen from scratches.

Sliding Grid

Figure 28:
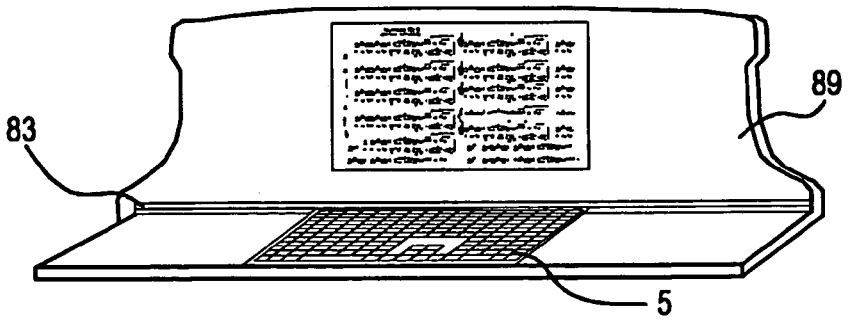
FIGS. 28-30 shows stages of movement of a sliding grid covering a keyboard on the music desk.
Figure 29:
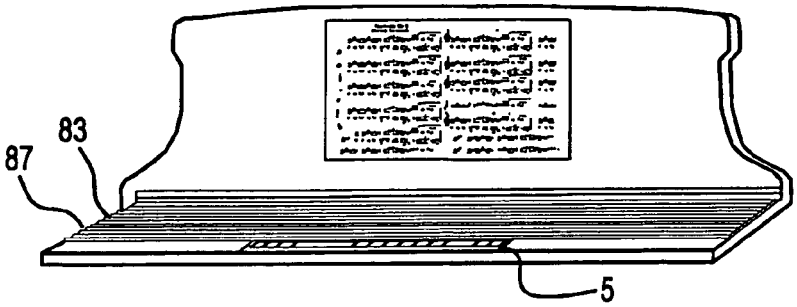
Figure 30:
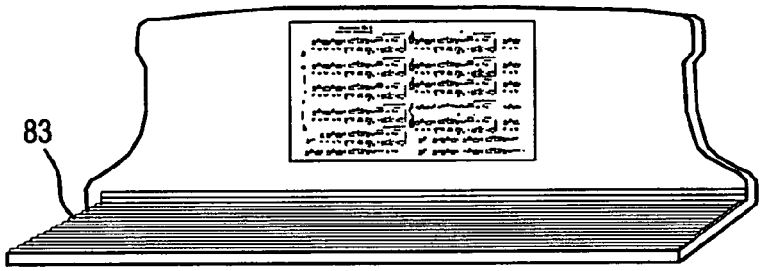

If the user would like to use sheet music on traditional grid grooves 87, this can be achieved by sliding a grid 83 over the typing keyboard 5, as shown in FIGS. 29 and 30. The grid is concealed as a pullout, flush to the bottom of the music desk 89, as shown in FIG. 28. The user can slide the grid back and forth over the typing keyboard as needed. This sliding grid can be moved manually or by remote control.

Figure 10:
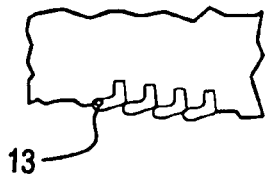
Figure 11:
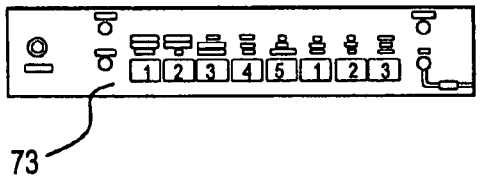

Instant Page-Turner Pedal

Where most conventional pianos come equipped with three pedals, the new pianos come with an additional pedal 13, shown in FIG. 10, as a page turning device to complete the pedal trap as four functional pedals. The Instant Page Turner pedal 13 preferably is located as the first pedal on far left. Tapping the pedal once advances the page to the next and/or subsequent pages, while tapping twice reverts to the previous page and/or back pages. Holding down the pedal 13 fast forwards pages. Tapping the pedal 13 once then holding it down rewinds pages. Taking the foot off the pedal 13 stops the page turning and displays the page where stopped.

Figure 24:
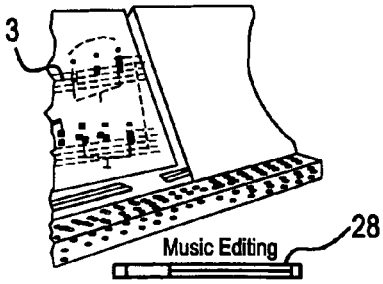

Music Editing with Wand

Where there is certain music that requires the pianist to follow notations such as the D.S. and Coda repeat signs, the user can mark a red dot or highlight these signs with a supplied editing wand 28, as shown in FIG. 24, which is part of the piano's music editing system. As the user plays the piano, the computer automatically turns the pages in accordance to the red dots.

The computer senses where the user is playing by the keys that are being pressed that coincide with the music displayed on screen, then turns the pages automatically so the user never has to take hands off the musical keyboard. Users can also set the computer to record and write notes onto music manuscript that coincide with the music being simultaneously played. The editing wand allows the user to add, change, and delete/erase certain notations, text, or marks on the pages. Also, users can mark/illustrate (write, draw, and edit) on the Music Desk Monitor screen with the wand, in various colors, in real time. The use can compose/write/draw onto several preinstalled music manuscript and scoring pages as well as blank pages. No marks will surface on the touch sensitive screen. The wand only transfers marks/illustrations into the page displayed, similar to an Etch-A-Sketch screen that is never marked. All work can be saved internally or saved onto a CD via its CD-RW drive.

Music Command Center

The new music desk monitor computer screen 3 is touch sensitive. A Music Command Center (MCC) 91, shown in FIG. 27, is a feature that is activated by editing tools 93 that appear on the Music Desk Monitor computer screen. The MCC 91 is superimposed over the existing music when activated by the editing tools. The focus density of the MCC 91 can be adjusted to appear from transparent to solid clarity. The MCC 91 is mobile and can be moved anywhere on the screen 3 from top to bottom, left to right. When activated after first usage, the MCC 91 will appear on screen 3 where the user last placed it.

As an option to using the Instant Page Turner pedal 13 to change pages on the screen, the user can touch a BACK icon 95 to revert to the previous page and/or back pages. Touching a NEXT icon 97 advances to the next page and/or subsequent pages. Holding down the BACK icon 95 rewinds pages. Holding down the NEXT icon 97 fast forwards pages. Taking the finger off either icon stops the page turning and displays the page where stopped. Also, pages can be programmed to automatically turn via the computer's Music Sensor 111 without use of the Instant Page Turner pedal 13 or by touching the touch sensitive Music Desk Monitor screen 3 on the MCC 91. The Music Sensor 111 locates where the user is playing in the music, then the Instant Page-turner turns each page accordingly. The user can also tap a measure anywhere in the music on any page to activate the Music Sensor. Tapping on a measure will indicate to proceed in the music from that measure.

Timing: Adjusting the Page Turning Timing

The user can adjust the timing of the changing incoming pages from slow fade-in to instant page turning, i.e., timing can be adjusted from 10 (fastest instant page turning) to 1 (slowest fade-in). From the last bar of music, back to the last 16 bars, can be assigned to remain on screen simultaneously while the next page of music appears on screen, so the user is able to read to the last note and then play the top of the next page of music seamlessly. The computer's Music Sensor 111, shown in FIG. 34, locates where the user is playing in the music. If the user has started playing the top of the next page, the computer signals the last assigned bar(s) of the previous music to fade-out and to be replaced by the new page of music, if applicable.

This command can be repeated throughout the entire work of music. There is no limit of commands that can be assigned and activated separately or simultaneously. The MCC 91 also has Menu Blocks 99 that are used to navigate 107 through the music and to signal the user when certain notations such as REPEAT, 101 D.S. sign 103, CODA 105, TRANSPOSE 107 and other internal assigned commands are near to activation. Each Menu Block 99, (SEE 101-107), can be assigned to flash 1 to 16 bars prior to activation as notice to the user.

The Music Sensors in the computer locate where the user is playing in the music, then the computer transfers the information to the Menu Blocks 99 to notify the user of the assigned commands. Each Menu Block 99 can store multiple commands and can be assigned in sequence: (a.) when to appear, and (b.) when to activate the command. As an example of options, the user can assign Menu Block #1 to REPEAT bars 16 through 32 for 2 times, #2 to go back to the TOP of music after bar 56, and TRANSPOSE music from the key of C to a ½ step up to the key of C# (or any other interval), and Menu Block #4 for the music to jump to the last 16 bars when taking the CODA sign.

Once the commands are set, the user can click the Music Command Center's icons off the page by tapping the OFF button. If the bars are not numbered, the user can touch the bars that need to be assigned. Those touched bars will highlight in color and will be assigned a desired bar number to form connected measures in succession or to rearrange the order of the music, i.e., assigning the music to start with the bridge instead of its original intro of music. Single bars or groups of bars can be highlighted to be 'cut and pasted' into another part of the music. Also, bars can be deleted, and bars from other sources of music can be inserted into the existing music on screen. The user can also touch the Menu blocks to command a function at certain programmed bars, or the user can command the music to activate a function instantly when touched, i.e., functions such as TRANSPOSE, back to the TOP, REPEAT, etc.

The multi-lingual editing tools software allows the user to choose from the numerous preinstalled languages to display in the Menu Blocks. All commands can be saved internally and/or saved to a CD via the built-in CD-RW drive.

MagnaVizion

From the Music Command Center, the visually impaired user can activate the presently named MagnaVizion 149 feature that displays a simulated magnifying lens that can be placed over any desired portion of music for enlargement while the remaining page stays intact. The user can assign certain measures or all of the music to be enlarged to desired proportions. The user has the option to program the magnifying lens to flow across the music with 1 to 4 measures enlarged ahead of each read measure, or program to allow assigned measures to magnify instantly without the lens on screen. A normal size measure can be enlarged to fill a full-page size. MagnaVizion 149 allows the user to enlarge from 1 up to 16 consecutive measures. These measures can be programmed to display music in consecutive sequences in seamless flowing groups, i.e., enlarge every 2 measures, every 4 measures, every 6 measures, every 8 measures, etc., up to 16. The Music Sensor will locate where the user is playing, then trigger the Instant Page Tuner to turn the pages as programmed. Total voice interaction can navigate the visually impaired user through all features and commands of MagnaVizion 149. Each measure and/or text can be customized to the user's viewing preferences. The user can record and save all activity and settings without having to continuously set up customized enlargement functions each time of usage. The user can then save the preferences internally or burn a copy onto CD via the CD-RW drive.

Because the new piano is interactive, the visually impaired user can activate all functions through its voice command. When the user commands a certain function to activate such as 'Trumpet Sound #2' from the MIDI Sound Module to play on the musical keyboard, the computer will beep to notify the user that the activation is complete. A buzzing sound will notify an activation failure. The interactive voice will explain the activation failure and then guide the user to achieve the desired function.

PianoInteract

PianoInteract, a feature 91 of the Music Command Center, can understand, react correspond, and implement voice commands when the user is speaking into a headset or near a built-in microphone 117 located on the bottom of the computer screen 3. The user can activate features on the new piano such as instant page turning, modulations, repeats, module sounds, pickup system, Internet activity, music editing, reading emails, reciting lyrics, etc. With PianoInteract, the user can create, compose, arrange music, and surf the Internet without typing. The user can speak normally and dictate up to 160 words-per-minute accurately. PianoInteract 91 will speak back 119 to the user, corresponding and implementing commands. It will even question and/or explain the process of each command. As in MagnaVizion 149, each completed activity can be programmed to notify the user of a successful activity with a beep, or a buzzing sound for activity failure. This is a helpful feature for composers who desire to translate music without using the musical keyboard. This is also a helpful feature for the visually impaired user along with other features noted in MagnaVizion.

When composing, the user can say into the microphone; "Treble clef—GO, measure 1—Go, in 4/4 time—GO, 'G' half note on line 2—GO, quarter rest—GO, 'E' quarter note on line 1—GO, NEXT MEASURE—GO, C-E-G triad whole notes—GO, NEXT MEASURE—GO, G7 chord on line 2—GO; (G-B-D-F notes will automatically form the chord from line 2 to complete the G7 chord)." Saying "Inverted" or "1st inversion" will cause the G7 chord to form: B-D-F-G. PianoInteract will invert chords from 1st to 13th in major, minor, diminished, and augmented inversions. Musical notes, accidentals, lyrics, and text can be commanded to write over the entire grand staff including all leger lines and spaces.

PianoInteract will keep track of each measure being composed and will speak to the user to notify each measure that is being worked on, i.e., "You are now working on Measure 5." PianoInteract will playback a commanded measure(s), i.e., "Playback measure 3." It will also spell out each activity in a measure(s), i.e., "Measure 1 includes treble clef, (beep), 4/4 time, (beep), 'G' half note on line 2, (beep), quarter rest, (beep), 'E' quarter note on line 1 (beep)."

PianoInteract includes interactive/corresponding teaching tutorial software that instructs the user on how to play the piano at various playing levels (beginner to advanced/professional) in numerous styles. A metronome is included in PianoInteract with the standard 'click' as well as several beats, rhythms and meters. PianoInteract will keep records 121 of documents/files and will instantly activate them by command. The built-in calendar 123 will keep accurate records of practice and performance schedules.

PianoInteract allows the composer to understand what the user is saying. With thousands of musical terms preinstalled, the commands are only a naturally speaking audible command away from instant activation. The user can also create new musical terms and save them internally. PianoInteract will create text-to-speech and vice versa 125.

Preinstalled interactive languages include English, Japanese, Spanish, German, Chinese, Korean, Italian, French, and certain Slavic dialects. Other languages can be ordered on a CD or downloaded from a web site. It can also instantly translate these languages for text, music terms, lyrics, etc. This important feature allows the user to instantly correspond live in real time with students, teachers, musicians, and conferencing worldwide—online as well as offline. PianoInteract will also allow user's to chat with others online while playing the piano, sending music and text via the Internet while chatting simultaneously for ongoing discussions. Connecting the video cam to the USB port will allow users to communicate and see each other when they are online.

Contents

The user can tap the activated PianoInteract 91 icon on the touch sensitive Music Desk Monitor screen for total voice command interaction (using the mouse manually is optional). The user can vocally select the "Contents" 155 which encompasses all features and functions. A listing of all features will then display on screen.

Instructions

PianoInteract 91 offers user/friendly visual and voice navigational instructions on how to operate all facets of the piano. The user just simply asks for "Instructions" 153. The user can select instructions/descriptions for all features and functions or for each listing individually. The user can also select the Interactive Video Manual to view all components, modules, and total functions/features of the piano. The Interactive Video Manual will interact and correspond with questions/answers on how to operate the piano while simultaneously displaying video illustrations that coincide. The user can adjust the size of the video (i.e., picture-in-picture) to be able to implement the instructions in 'real time' as they are given. Categories of basic, intermediate, and advance are available levels of instructions with in-depth capabilities of the piano. Users can also connect to the Internet for additional live technical support, as well as download new features into the piano computer.

Piano Security

For security 151, PianoInteract 91 includes locking codes, pass codes, and detects speech and voice recognition to activate its components. When the security lock is implemented, only the acoustic piano is functional. No computerized components, monitors, modules, etc., or otherwise are operable, however, all features can be selected a la carte to function without the remaining features being activated. For example, the built-in Speaker Monitors, Pickup System, and Jack Plug can be activated exclusively without other features being operable.

When the piano power is turned on, PianoInteract 91 is automatically in effect, however, no component will be activated until the user taps the small PianoInteract icon on the bottom of the Music Desk Monitor screen. The Music Desk Monitor will not be lighted. Only the icon will appear. If the piano is in 'lock mode,' the user will have to play certain saved piano key combinations on the piano for activation. The user can play up to any 12 key combinations, using all octaves as the password, i.e., C1, G2, Eb7, F#6, A5, D4, etc., then tap the icon. Once the password is accepted, the Music Desk Monitor will light for access. If the master user set the piano for limited access, i.e., only the built-in Speaker Monitors, Pickup System, and Jack Plug are activated, then only those features will be operable. The piano can be set up to allow several locking codes. These codes can be programmed to allow limited or full usage of the new piano for certain individual users.

Sequencer

Figure 34:
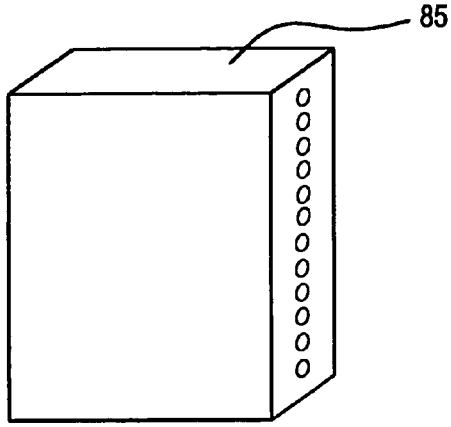
FIG. 34 shows a computer and components for connection via an interface to the computer.
Figure 35:
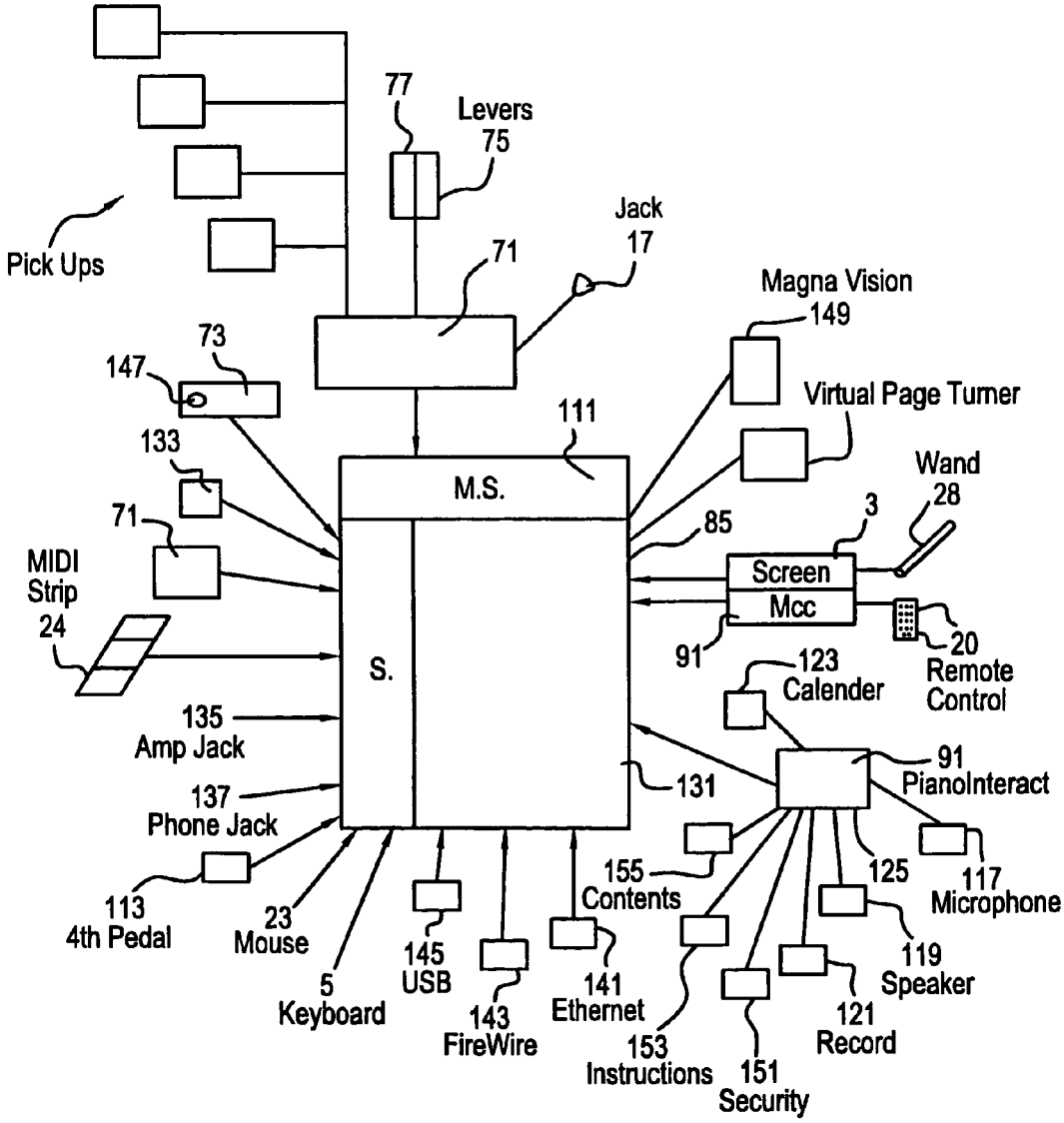
FIG. 35 is a schematic representation of inputs and outputs of the computer.

The computer 85, shown in FIGS. 34 and 35, has a built-in sequencer with at least 16 recordable tracks 131 with features including: MIDI system 73, MIDI ports 133, jack-in 135, and jack-out plugs 137. The sequencer allows the user to record unlimited notes into the computer, adjust the value of each note, quantize each note and/or entire work, and save internally and/or onto CD via the MIDI Sound Module's 71 CD-RW drive 7. Music can be recorded in 'Sympte' or other 'time codes' and be sent and received as documents/files over the Internet. The computer will also allow the user to upgrade the sequencer as well as install other music composing and sequencing software of choice.

Computer/Typing Keyboard

The computer 85 is functional and operational as any conventional computer but with numerous exclusive features. Users can compose, edit and read typed or scanned lyrics/text on the screen. The computer offers the most powerful updated versions of PC and Macintosh operating systems. Both systems can exist in full function simultaneously. Users can open each document/file then burn it onto a CD via the built-in CD-RW drive. The computer comes with Ethernet 141, FireWire 142, and USB 143 connections. Users can title and file all music and text by using the typing keyboard 5 that is located at the bottom of the Music Desk Monitor 3 screen and save information onto a CD via the built-in CD-RW drive or in the piano's computer 85.

Mouse

Even though this mouse 23 is operated the same as any standard computer mouse, this mouse will include features that are new and exclusive to the new piano. This mouse 23 allows the user to highlight certain lines, measures, sections, or the entire music work to be sent to print, i.e., selecting line #3—the 4th trumpet part, and then send it to print. The computer 85 will send information to the printer to print the music in seamless sequence. Music will be printed as consecutive connected measures—line-by-line as standard manuscript sheet music.

MIDI Sound Module

An equipped MIDI Sound Module has over 300 useful digital sounds to play simultaneously with the acoustic piano or play exclusively without the sound from the acoustic piano. Users can create, enhance, replace, and edit these preinstalled digital sounds as well as edit additional sounds that can be downloaded into the MIDI Sound Module 73. Also, sounds can be downloaded into the computer then downloaded into the MIDI Sound Module and vice versa. Additional MIDI sound devices can be connected through the MIDI inputs/outputs. The touch sensitive MIDI Sensor Strip 24, located under the piano keys, allows the user to trigger sounds that coincide with each pressed key. The module also has headphone and microphone jack plugs 147. The Pitch Bend and Modulation Levers located on the front left Side Block allows users to alter real-time sounds from the module such as ascending/descending pitches, and pitch/notes vibrato. Adjustable stereo digital effects such as reverb and chorus are also included in this high-tech module.

Octave Buffer

Figure 31:
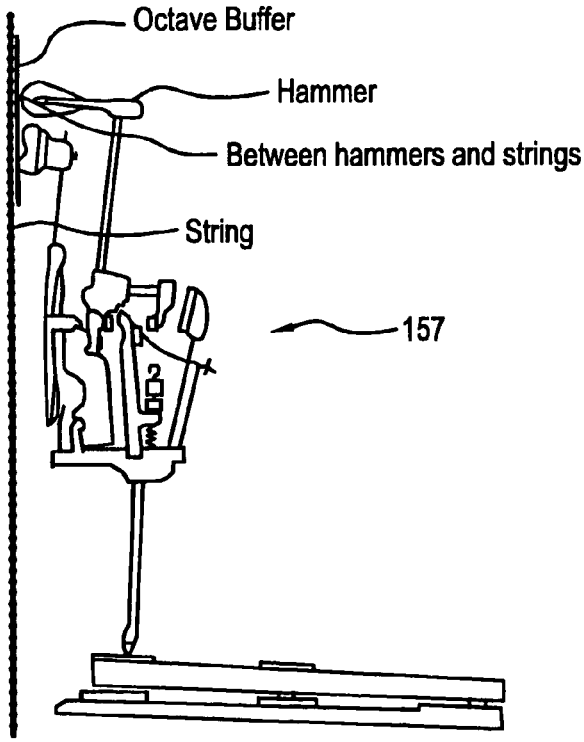
FIG. 31 shows an octave buffer for upright and console pianos.
Figure 32:
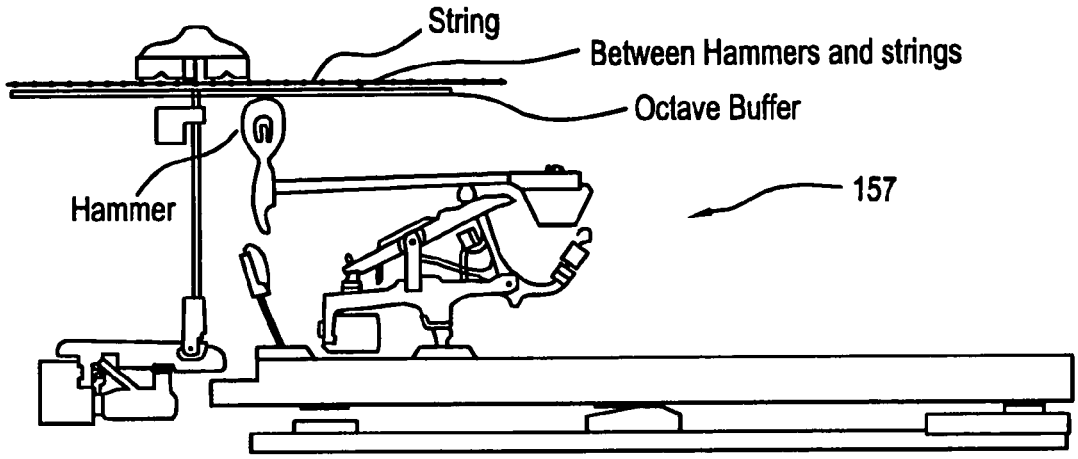
FIG. 32 shows an octave buffer for grand pianos.
Figure 33:
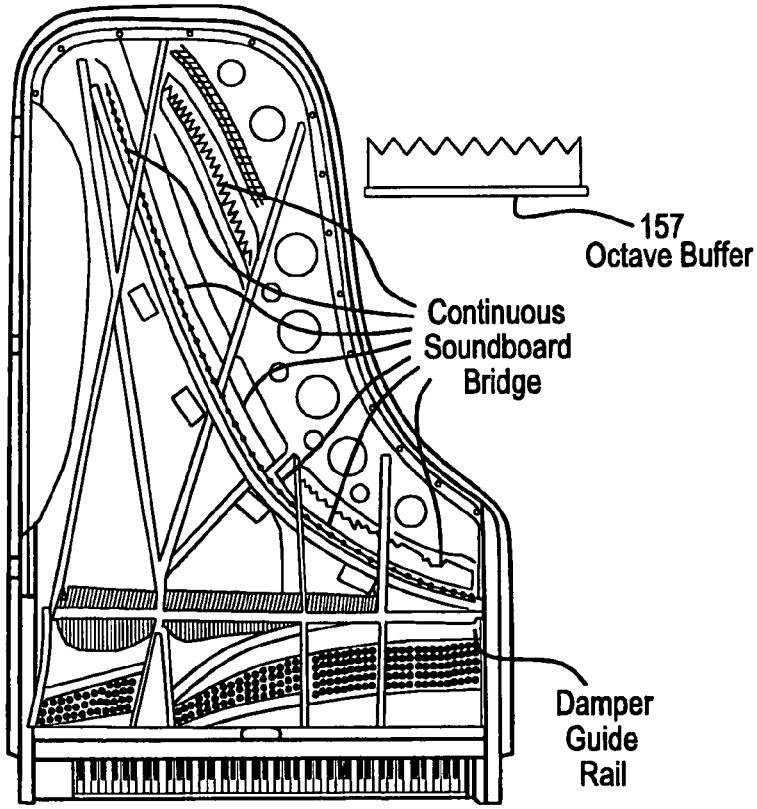
FIG. 33 shows octave buffer mountings for grand pianos.

Sounds from the MIDI Sound Module can be played exclusively without hearing the acoustic piano when the Octave Buffer 157, see FIGS. 31 to 33, is applied. In each octave, the user can choose to play all acoustic piano or play acoustic piano simultaneously with MIDI Sound Module sounds. Also, the user can assign various options to each octave, i.e., the user can choose to play only synthesizer bass in the 1st octave (with Octave Buffer ON), only horns in the 2nd octave (with Octave Buffer ON), only acoustic piano in the 3rd octave (with Octave Buffer OFF—no assigned sounds from MIDI Sound Module), only strings in the 4th octave (with Octave Buffer ON), and acoustic piano and organ simultaneously in the 5th octave (with Octave Buffer OFF—with assigned sounds from MIDI Sound Module). The Octave Buffer is preferably located in several locations to mute the sound of the acoustic piano; (a.) along the side of the Continuous Bridge, which includes bass/tenor/alto/treble sections; (b.) attached continuously along the Damper Guide Rail block; (c.) buffers that go between hammers and strings.

When the Octave Buffer is ON, the loud pedal then becomes a sustain pedal for the sounds in the MIDI Sound Module. The buffers will not affect or change the feel of the hammer striking the string; consequently the touch of the piano will not be altered. The user will feel as if they are still playing the acoustic piano even when triggering the sounds from the MIDI Sound Module. The Octave Buffer is activated and controlled by the MIDI Sound Module. Easy access press buttons on the module allows the user to quickly activate all or selected different sections of the piano to be muted/un-muted by the Octave Buffer.

Pickup System

The new piano has at least four pickups that are strategically placed on the most vibrant locations on the soundboard to transcend the optimum sounds of the piano (1 bass, 1 tenor, 1 alto, 1 treble). The Pickup System control module, located on the front of the piano, can electronically control the tone of each pickup individually via its graphic equalizer and is designed to reproduce music naturally, clearly, and dynamically with spatiality. When more bass is desired, the user can press the bass button, then the equalizer options will appear on its screen to create the various bass timbers desired (deep bass, mid-range, high-end bass, top peak, etc.) from 1 (deep bass) up to 10 (top peak). The same options apply to the remaining pickups. The Pickup System's graphic equalizer allows the user to achieve a desired sound by adjusting each section's pickup, i.e., from lowest bass, to midrange, to highest treble, as well as the various semi-tones in between. Also, volume for each pickup can be controlled individually from 1 (soft) to 10 (loud).

Once the user achieves the desired sound through adjustments on the pickup system module, these settings can be saved internally in the pickup system module and/or burned onto a CD via the built-in CD-RW drive. The user can save the desired volume, tone, and all music documents/files onto a CD and load it into any similar piano's CD-RW drive. The piano will automatically adjust in accordance to the settings on the CD.

On the front of the Pickup System module is a mute button that is used to instantly turn down the volume. Volume from all components, amplifiers, modules, and speakers will shut off when the mute button is pressed. The sign 'MUTE' will appear on the LED panel. The user can press the mute button a second time to regain the previous volume, and the "MUTE" sign will turn off.

Built-in Speaker Monitors

The pickups and the Pickup System transfers sound to two built-in speaker monitors. These adjustable rotating speaker monitors are located on the front of the piano (one on each side) to assist the user in hearing the richness, tone, and volume of the piano sound. These sophisticated speakers are designed to deliver the sound of the piano, not the sound of the system. The objective is to transcend, enhance, and accentuate the actual sound generating from the piano. These speakers will envelop the user with a realistic feel of three-dimensional space that surrounds and transports sound. These correctly balanced compact speakers can duplicate the volume and tone of much larger speakers, with a design to separate treble, midrange, and bass with pure lucidity and spatiality—flowing effortlessly from whisper to roaring without strain or distortion. Whether at low volume or high volume, these speakers have the capacity to deliver the heaviest of bass and the highest of treble at low volumes. Volume does not impede the tone delivered through the speakers. Programmed tones of heavy bass or high treble will remain prominent from high volume settings to off.

Jack Plug

For additional amplification, the piano is equipped with an output jack plug. Presently a quarter inch jack cord can be used to connect the piano to amplifiers, monitors, speakers, P. A. systems, etc. Also, the new pianos come with accessorized wireless antenna system attachments, using similar equipment as wireless guitar and microphone systems. A wireless attachment is plugged into the piano. The signal from the piano is sent to the main base wireless unit to achieve additional amplification.

Telephone Jack

The new pianos are the only pianos wired for the Internet. A telephone jack is preferably located on the side of the piano. For Internet access, one end of the telephone cord is plugged into the jack on the piano. The other end is plugged into a live telephone wall jack. The new pianos have accessorized wireless antenna system attachments. The signal from the piano is sent to the main base wall wireless unit, from where it may be further transmitted over the Internet. Users can send and receive music over the Internet just like any conventional computer but with additional exclusive highlights, i.e., the user can email recorded and printed music for end-user to open—listen and read, record sequenced or un-sequenced music and send it as 'Sympte' or 'time coded' music to be used as actual recordings, and purchase online music and download it instantly as actual manuscript music.

Palm Pilot

Users can use a Palm Pilot to compose music then download information into the piano computer via the USB port and save it.

Remote Control

Even though the electronic components can be operated manually, the new piano comes with a remote control. The remote control can operate the MIDI Sound Module, Pickup System module, CD-RW drive, Music Desk Monitor screen (which includes controlling all contents in the computer), scanner, etc.

Battery Pack

A battery pack is used to power all AC components on the piano as an option to standard AC units such as wall plugs, sockets, generators, etc. The battery pack can sustain all electronic functions on the piano for a minimum of 3 hours.

Hard Drive

A portable hard drive is insertable and removable from the on board computer and allows users to transfer, download and save information from the new piano as well as from other computerized sources.

The Amplifier

A built-in amplifier offers at least a powerful 50-Watt amplifier to run all the electrical components on the new piano. This built-in amplifier includes anti-feedback filters that reduce unwanted feedback to help deliver clean and precise natural tones. An internal limiter ensures maximum output while the sound remains distortion free. Unlike amplifiers that are designed for electric pianos and guitars, the new amplifier is intensely designed for the wide array of various tones and pitches of an acoustic piano. This amplifier, coupled with the pickups, translates accurate timbres from the soundboard that are independent of pitch and volume. The new amplifier has at least four ¼ inch jack inputs, affording independent volume and EQ controls for each pickup, and at least four RCA channels for external audio equipment such as the MIDI Sound Module. Even though the new 50-Watt amplifier offers more than enough power for typical music venues, a ¼ inch line-out jack on the piano allows connectivity directly to external PA systems, monitors, and additional amplifiers for more volume.

Referring to FIG. 34, the following listed items are components and features that are run by the computer. However, the second list is a group of components and features that can function independently in the piano without the assistance of the computer. The MIDI Sound Module is a separate component that runs the Pitch Bend and Modulation Levers, MIDI Sensor Strip, internal sounds, Octave Buffer, and headphone jack. The Pickup System runs the four pickups, built-in speaker monitors, and jack plug. The amplifier powers both MIDI Sound Module and Pickup System. The MIDI Sound Module can be controlled to a certain degree by the computer via MIDI connections, i.e., commands for internal sounds, song sequencing, and sound effects manipulation. Even though they can be connected to the computer via MIDI connections, they are still not necessarily internal parts or extensions of the computer.

FIG. 34 shows internal software, external inputs and outputs, components, and features run by the computer. Components and features run by the built-in computer include: scanner 9, Music Desk Monitor 3, Sliding Grid, Instant Page Turner system, MIDI connections, music editing with wand 28, microphone 117, Music Command Center 91, voice command, sequencer, computer 85, typing keyboard 5, Ethernet 141, Firewire 143, USB 145, mouse 23, telephone jack 137, Palm Pilot, remote control 20, hard drive, Instant Page Turner pedal 113, Music Sensor, Menu Blocks, PianoInteract 91, MagnaVizion 149, built-in microphone 117, built-in calendar 123, CD-RW drive, PC and Macintosh computers and their operating systems.

Components that can function without the computer include the following:

Pitch Bend and Modulation Levers, MIDI Sensor Strip, Headphone Jack, MIDI Sound Module, Octave Buffer, Built-in Speaker Monitors, Jack Plug, Battery Pack, the new Piano Amplifier.

FIG. 35 is a schematic diagram showing the connection of peripherals. Additional details of high technology acoustic piano parts are described below:

A Case hereinafter referred to as a "piano body" is the wooden inner and outer rim framework to which the Soundboard is glued to and the iron Plate is bolted to. The Soundboard and Plate are mounted to the inner rim. Certain models of the new piano are constructed with inner and outer rims made as one piece to provide a stronger foundation for both structure and sound. Various woods are used to construct the Piano Body such as laminated maple, spruce, and beech.

A Frame, hereinafter referred to as "Plate," is a cast iron frame that supports the high tension of strings. Strings are connected to the tunings pins, and then stretched across the Plate (aligned by certain bridges) to connect to hitch pins of the Plate. Strings stretched over the plate causes a tension at, i.e., (a.) uprights to mid-size grands combine a tension pull of approximately 18 tons. (b.) large grands such as 9' concert grands approximate 30 tons of tension pull.

A Soundboard in the acoustic piano is the amplifier of sound, tone, and volume that transmits vibrations from the strings. It is usually made from Sitka spruce and planed approximately ⅜" thick; the soundboard is mounted under the Plate and over the Ribs.

Treble strings are made of steel while bass strings have a steel core with a copper winding. There are over 200 strings in a piano. Strings are divided in three groups; (a.) treble notes usually have 3 strings. (b.) upper bass have 2 strings. (c.) lower bass notes have 1 string. The lower the note in pitch, the larger the string, and the higher the note in pitch, the thinner the string.

An Action has many thousands of parts that are adjusted and regulated to transmit speed, evenness, control, and power. Some of the action parts consist of materials made of wood, cloth, felt, buckskin, brass, plastic, paper, and steel. Some of the movable inner workings of the piano action include: whippens, jacks, hammers, and keys. The user presses the keys, and then the keys trigger the connected hammers to simultaneously strike the strings in a precise chain reaction with accuracy as high as a thousandth of an inch.

A Pinblock is a laminated plank made of a hardwood such as maple or beech that runs the width of the piano and is mounted to the inner rim of the Piano Body. The tuning pin section of the Plate is seated over the Pinblock. Tuning Pins are inserted into the Plate and further embedded down through the holes in the Pin Block. Tuning Pins are designed to maintain the string's tension to a preferred tuning pitch, i.e., A-440 standard pitch, as individual strings are tightly wound around each steel Tuning Pin.

There are two different bridges that are mounted onto the soundboard. The treble bridge is long and curved while the bass bridge is short and straight. Bridge pins made of steel are driven into the bridges to keep the strings aligned and to assist in sound transmission. Solid or laminated wood Bridges are made of maple or beech.

The high technology piano has 4 pedals. Pedal #1, far left is the Instant Page Turning Pedal; Pedal #2 on uprights/consoles is the 'soft' pedal that moves the action closer to the strings to lessen the hammer's blow to soften the sound, while in grands it shifts the action to right so that less strings are struck by the hammers to soften the sound; #3 isolates and raises the bass dampers off the strings exclusively or drops a felt "muffler" strip between the piano hammers and the strings to soften the sound; Pedal #4 is the loud or sustain pedal that releases the dampers off strings and allows the sound to project in full vibration.

While the invention has been described with reference to specific embodiments, modifications and variations of the invention may be constructed without departing from the scope of the invention, which is defined in the following claims.

I claim:

1. A piano apparatus comprising:

a piano body;

an action;

a harp plate;

pinblock mounted on the piano body;

a musical keyboard with keys connecting to the action;

hammers connecting to the action;

strings connecting to the harp plate, positioned adjacent to the hammers, and arranged in different groups of strings according to respective principal frequency ranges, each of the different groups of strings being associated with a respective one of a plurality of different groups of the keys of the musical key board;

a soundboard connected to the piano body and positioned relative to the strings;

a MIDI sensor strip mounted beneath the keyboard for detecting movements of the keys;

a plurality of buffers for selectively muting at least one of the plurality of different groups of the keys of the musical keyboard from generating sounds via the respective one of the plurality of groups of strings; and a plurality of pickups relatively positioned between the soundboard and the different groups of strings for picking up string vibration frequencies from each of the different groups of strings when one or more of the respective different group of the keys are not selected to be muted by an associated one of the plurality of buffers, the picked-up string vibration frequencies being provided to amplifiers for various speakers, when any one or more of the different groups of keys are selected for muting, the MIDI sensor strip detects the movements of each muted key and effects a generation of associated MIDI sounds via the various speakers.

2. The apparatus of claim 1 wherein connectors comprising jacks are mounted on the piano body.

3. The apparatus of claim 1 wherein the amplifiers and the speakers are mounted on the piano body, and wherein at least two of the speakers are movably mounted on the piano body near the musical keyboard.

4. The apparatus of claim 3 further comprising separate controls mounted on the piano body near the musical keyboard and connected to the amplifiers for separately controlling tone and volume outputs of each pickup.

5. The apparatus of claim 1 further comprising a computer connected to the piano body, a flat panel display mounted on a music desk above the musical keyboard, and a computer connected to the flat panel display for storing and displaying musical scores, printed/written/drawn materials and text on the flat panel display.

6. The apparatus of claim 5 further comprising three conventional pedals connected to the piano body and a fourth pedal connected to the piano body and to the computer for advancing the displaying of musical scores on the display under control of the fourth pedal.

7. The apparatus of claim 5 wherein the computer is an onboard computer mounted on the frame under the musical keyboard for storing musical scores, word processing text, and recording music from the pickups, modules, amplifiers, and external outboard gear.

8. The apparatus of claim 7 wherein the onboard computer has a removable hard drive, which is accessible near the musical keyboard.

9. The apparatus of claim 7 wherein the onboard computer further comprises a coupled CD player and CD burner.

10. The apparatus of claim 7 further comprising a computer keyboard mounted on the piano body beneath the flat panel display and connected to the computer for changing and writing musical scores, editing notations on the scores, and writing or editing word processing text.

11. The apparatus of claim 7 further comprising a mouse positioned on a flat surface of the piano body and communicating with the onboard computer.

12. The apparatus of claim 7 further comprising a music editing touch wand for annotating and editing musical scores on the display.

13. The apparatus of claim 7 further comprising a MIDI system mounted on the piano body and connected to the onboard computer and the MIDI sensor strip.

14. The apparatus of claim 7 further comprising a telephone connector jack mounted on the piano body and connected to the onboard computer for connecting the onboard computer to the Internet.

15. The apparatus of claim 7 further comprising a scanner mounted on a slide connected to the frame beneath the musical keyboard and connected to the onboard computer for scanning and storing musical scores, printed, written or drawn materials and word processing text in the onboard computer.

16. The apparatus of claim 7 further comprising a piano battery pack mounted on the piano body and connected to the onboard computer and to the amplifiers for supplying power thereto.

17. The apparatus of claim 7 further comprising a portable computer connected to the onboard computer by a computer connector or an Ethernet for exchanging musical scores, notations, text, and printed, written or drawn materials between the portable computer and the onboard computer.

18. The apparatus according to claim 1, further comprising a MIDI system for generating the associated MIDI sounds, the plurality of different groups of keys of the musical keyboard effect sound generation through the MIDI system, the strings, or both the MIDI system and the strings.

* * * * *